US009303906B2

(12) United States Patent
Morimoto et al.

(10) Patent No.: US 9,303,906 B2
(45) Date of Patent: Apr. 5, 2016

(54) AIR-CONDITIONING APPARATUS

(75) Inventors: Hiroyuki Morimoto, Tokyo (JP); Koji Yamashita, Tokyo (JP); Shinichi Wakamoto, Tokyo (JP); Naofumi Takenaka, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 363 days.

(21) Appl. No.: 13/877,080

(22) PCT Filed: Nov. 19, 2010

(86) PCT No.: PCT/JP2010/006798

§ 371 (c)(1),
(2), (4) Date: Mar. 29, 2013

(87) PCT Pub. No.: WO2012/066608

PCT Pub. Date: May 24, 2012

(65) Prior Publication Data

US 2013/0186126 A1 Jul. 25, 2013

(51) Int. Cl.

| | |
|---|---|
| ***F25B 13/00*** | (2006.01) |
| ***F25B 41/04*** | (2006.01) |
| *F25B 25/00* | (2006.01) |

(52) U.S. Cl.

CPC ..... *F25B 41/046* (2013.01); *F25B 13/00* (2013.01); *F25B 25/005* (2013.01); *F25B 2313/0272* (2013.01); *F25B 2313/02331* (2013.01); *F25B 2313/02741* (2013.01); *F25B 2400/121* (2013.01)

(58) Field of Classification Search

CPC ..... F25B 41/046; F25B 13/00; F25B 25/005; F25B 2313/0272; F25B 2313/02741; F25B 2313/02331; F25B 2400/121

See application file for complete search history.

(56) References Cited

U.S. PATENT DOCUMENTS 5,156,014 A * 10/1992 Nakamura ..... F24F 3/065 62/160
5,369,958 A * 12/1994 Kasai ..... F24F 3/065 62/158

(Continued)

FOREIGN PATENT DOCUMENTS

JP 63-318449 A 12/1988
JP 06265232 A 9/1994

(Continued)

OTHER PUBLICATIONS

Office Action mailed Sep. 3, 2014 in corresponding CN patent application No. 1201080070225.4 (with English translation).

(Continued)

*Primary Examiner* — Emmanuel Duke
(74) *Attorney, Agent, or Firm* — Posz Law Group, PLC

(57) ABSTRACT

To reduce pressure loss of refrigerant while suppressing a cost increase.

[Solution] In an air-conditioning apparatus 100 having a compressor 201, a radiator 204 (301), an expansion device 302, and an evaporator 301 (204), which are connected by a refrigerant pipe to form a refrigeration cycle, at least a part of the refrigerant pipe (207, 208, 209, 210, 211, 212) that connects from the suction side of the compressor 201 to the evaporator 301 (204) is configured by a plurality of pipes connected in parallel, and a refrigerant that flows through the refrigeration cycle is a tetrafluoropropene-based refrigerant or a refrigerant mixture having tetrafluoropropene as a main component.

12 Claims, 10 Drawing Sheets

(56) References Cited

U.S. PATENT DOCUMENTS

| | | | | |
|---|---|---|---|---|
| 5,388,420 | A * | 2/1995 | Yoshida | F25B 7/00 165/902 |
| 5,651,265 | A * | 7/1997 | Grenier | 62/260 |
| 6,287,088 | B1 * | 9/2001 | Nishimura et al. | 417/297 |
| 6,755,038 | B2 * | 6/2004 | Hwang | F25B 13/00 62/175 |
| 6,971,244 | B2 * | 12/2005 | Domyo | 62/114 |
| 7,587,909 | B2 * | 9/2009 | Yoon | F25B 13/00 62/324.1 |
| 8,091,377 | B2 * | 1/2012 | Jeong | F25B 13/00 62/159 |
| 2004/0035135 | A1 * | 2/2004 | Park | F25B 13/00 62/324.6 |
| 2004/0134205 | A1 * | 7/2004 | Park | F25B 13/00 62/151 |
| 2006/0043331 | A1 * | 3/2006 | Shankland et al. | 252/67 |
| 2006/0090495 | A1 * | 5/2006 | Choi | F25B 49/005 62/324.1 |
| 2006/0137381 | A1 * | 6/2006 | Choi | F25B 13/00 62/324.1 |
| 2009/0145151 | A1 * | 6/2009 | Wakamoto et al. | 62/259.1 |
| 2010/0146994 | A1 * | 6/2010 | Tomioka | F25B 13/00 62/84 |

FOREIGN PATENT DOCUMENTS

| | | | | |
|---|---|---|---|---|
| JP | 08-5201 | A | 1/1996 | |
| JP | 2010101588 | A | 5/2010 | |
| JP | 2010255966 | A * | 11/2010 | F25B 41/046 |
| WO | WO 2010002014 | A1 * | 1/2010 | C09K 5/04 |
| WO | 2010098447 | A1 | 9/2010 | |
| WO | 2010131378 | A1 | 11/2010 | |

OTHER PUBLICATIONS

Office Action mailed Feb. 18, 2014 issued in corresponding JP patent application No. 2012-544010 (and English translation).

International Search Report of the International Searching Authority mailed Jan. 18, 2011 for the corresponding international application No. PCT/JP2010/006798 (with English translation).

Office Action dated Apr. 10, 2014 issued in corresponding EP patent application No. 10 859 646.1.

Extended European Search Report dated Jul. 23, 2014 issued in corresponding EP patent application No. 10859648.1.

Office Action issued May 18, 2015 in the corresponding CN patent application No. 201080070225.4 (English translation attached).

* cited by examiner

FIG. 10

| REFRIGERANT | R410A | HFO1234yf |
|---|---|---|
| GAS DENSITY [kg/m3] | 29 | 14 |

FIG. 11

| HORSEPOWER HP/Kw | PIPE DIAMETER D1 [mm] | PIPE DIAMETER D2 [mm] |
|---|---|---|
| 8HP/22.4kW | 38.1 | 26.9 |
| 10HP/28kW | 44.5 | 31.5 |
| 12HP/33.5kW | 44.5 | 31.5 |
| 14HP/40.0kW | 50.8 | 35.9 |

AIR-CONDITIONING APPARATUS

CROSS REFERENCE TO RELATED APPLICATIONS

This application is a U.S. national stage application of PCT/JP2010/006798 filed on Nov. 19, 2010.

TECHNICAL FIELD

The present invention relates to an air-conditioning apparatus, and in particular, relates to an improved refrigerant circuit configuration.

BACKGROUND ART

From the viewpoint of global warming, there are some moves to restrict the use of hydrofluorocarbon (HFC)-based refrigerants (for example, R410A, R404A, R407C, R134a, and the like) with high global warming potential as refrigerants adopted for air-conditioning apparatuses. Accordingly, air-conditioning apparatuses that adopt refrigerants with small global warming potential (for example, HFO1234yf (hydrofluoroolefin), carbon dioxide, and the like) instead of HFC-based refrigerants have been proposed (see, for example, Patent Literature 1).

When an air-conditioning apparatus is installed in a large structure such as an office building, for example, the distance between an outdoor unit and an indoor unit becomes long in some cases. As a result, the refrigerant pipe becomes long, which increases the refrigerant circuit scale (system capacity). In air-conditioning apparatuses with large refrigerant circuit scale, in comparison to those with small refrigerant circuit scale, the flow rate of refrigerant increases accordingly, which increases the pressure loss of refrigerant. Accordingly, the problem is addressed by, for example, increasing the inside diameter of a refrigerant pipe through which a low pressure refrigerant that undergoes noticeable pressure loss flows.

In addition, as a technique for reducing pressure loss, there has been proposed a technique in which a bypass is provided from a refrigerant pipe through which a high pressure liquid phase refrigerant flows (high pressure side refrigerant pipe), to a refrigerant pipe through which a low pressure refrigerant flows (low pressure side refrigerant pipe) (see, for example, Patent Literature 2). The technique disclosed in Patent Literature 2 has a refrigerant circuit configuration in which a bypass is provided from the high pressure side refrigerant pipe to the low pressure side refrigerant pipe so that a part of the high pressure liquid phase refrigerant is passed to the low pressure side refrigerant pipe. Through this configuration, of the refrigerant flowing through the low pressure side refrigerant pipe, a low pressure refrigerant that undergoes large pressure loss is reduced in flow rate, thereby reducing pressure loss.

CITATION LIST

Patent Literature

Patent Literature 1: Japanese Unexamined Patent Application Publication No. 2010-101588 (see, for example, FIG. 1)

Patent Literature 2: Japanese Unexamined Patent Application Publication No. 6-265232 (see, for example, FIG. 1)

SUMMARY OF INVENTION

Technical Problem

As mentioned above, there have been proposed air-conditioning apparatuses that adopt HFO1234yf, which has a small global warming potential, as a refrigerant for the air-conditioning apparatuses. In comparison to HFC-based refrigerants, this HFO1234yf suffers from large pressure loss owing to its small density in a low pressure state (gas state or two-phase gas-liquid gas state). Further, in a case where such an air-conditioning apparatus is installed in a large structure such as an office building, for example, and the refrigerant pipe becomes long, the flow rate of the refrigerant increases, leading to greater pressure loss.

That is, in a case where HFO1234yf is adopted as a refrigerant for an air-conditioning apparatus, or the refrigerant circuit scale of an air-conditioning apparatus is large, when the pipe diameter of the refrigerant pipe is increased to reduce pressure loss, the machinability of the refrigerant pipe deteriorates, leading to a corresponding increase in cost. Moreover, the manufacturing cost of a refrigerant pipe with a large pipe diameter itself is high, leading to a further increase in the cost of the air-conditioning apparatus.

The invention has been made to overcome the above problems and aims to reduce pressure loss of refrigerant while suppressing an increase in cost.

Solution to Problem

An air-conditioning apparatus according to the invention includes a compressor, a radiator, an expansion device, and an evaporator, which are connected by a refrigerant pipe to form a refrigeration cycle, in which at least a part of the refrigerant pipe that connects from the evaporator to a suction side of the compressor is configured by a plurality of pipes connected in parallel, and a refrigerant that flows through the refrigeration cycle is a tetrafluoropropene-based refrigerant or a refrigerant mixture having tetrafluoropropene as a main component.

Advantageous Effects of Invention

In the air-conditioning apparatus according to the invention, at least a part of the refrigerant pipe that connects from the evaporator to the suction side of the compressor is configured by a plurality of pipes connected in parallel, thereby reducing pressure loss of the refrigerant while suppressing an increase in cost.

BRIEF DESCRIPTION OF DRAWINGS

FIG. 10 shows density at 0 degrees C. of a HFO1234yf refrigerant and a R410A refrigerant.

FIG. 11 shows refrigerant pipe diameters in a case where two refrigerant pipes are substituted for a single refrigerant pipe of a predetermined diameter, at various outputs of a compressor.

DESCRIPTION OF EMBODIMENTS

Embodiments of the invention will be described below with reference to the drawings.

Embodiment 1

Figure 1:
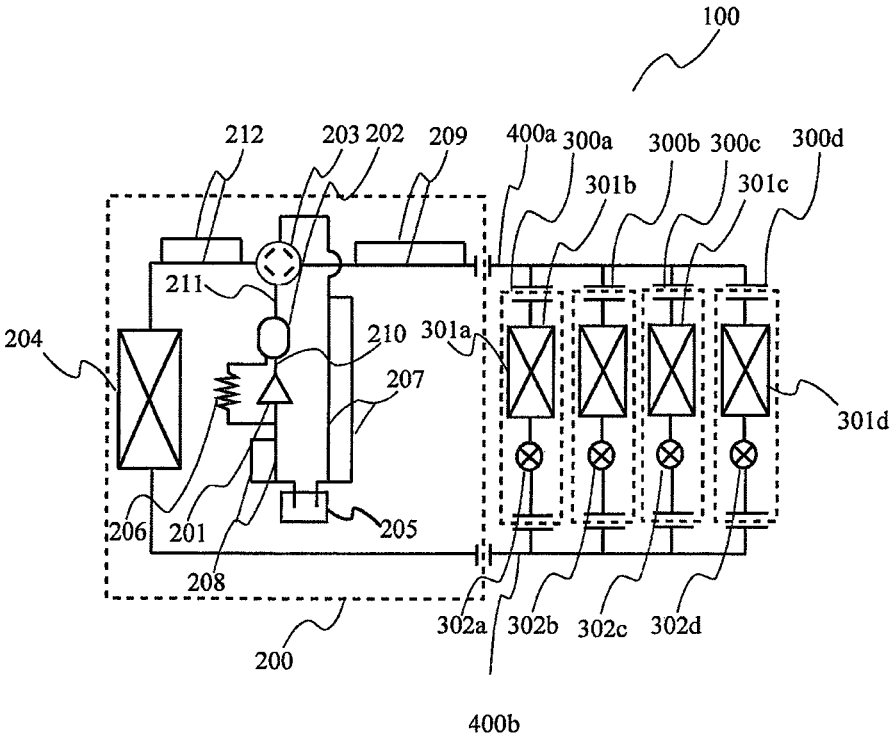
FIG. 1 illustrates an exemplary refrigerant circuit configuration of an air-conditioning apparatus according to Embodiment 1 of the invention.

FIG. 1 illustrates an exemplary refrigerant circuit configuration of the air-conditioning apparatus according to Embodiment 1 of the invention. The refrigerant circuit configuration of an air-conditioning apparatus 100 will be now be described referring to FIG. 1. While indoors units are configured by four indoor units 300*a* to 300*d* as illustrated in FIG. 1 in the following description, the number of indoor units is not particularly limited. Note that the dimensional relationship among components in FIG. 1 and the other figures may be different from the actual one. The indoor units 300*a* to 300*d* will be sometimes simply referred to as indoor unit 300.

As illustrated in FIG. 1, the air-conditioning apparatus 100 includes an outdoor unit (heat source unit) 200 and indoor units 300 (indoor unit 300*a* to 300*d*) connected by refrigerant pipes 400 (refrigerant pipes 400*a* and 400*b*). Specifically, in the air-conditioning apparatus 100, indoor units 300*a* to 300*d* are connected by the refrigerant pipes 400 so as to be in parallel to the outdoor unit 200. For the air-conditioning apparatus 100, a refrigerant with small global warming potential and with flammability (for example, tetrafluoropropene-based refrigerant such as HFO12341y or HFO1234ze) is used. Furthermore, it can be a mixed refrigerant containing the above.

Figure 13:
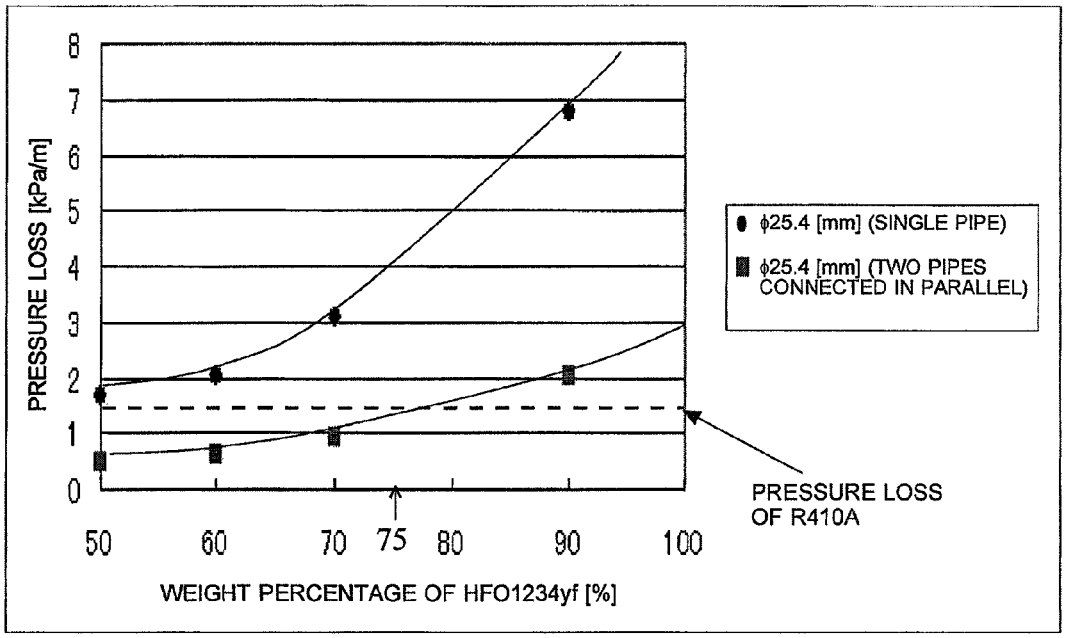
FIG. 13 illustrates the relationship between the ratio (weight percentage) of HFO1234yf contained in a refrigerant, and pressure loss.

FIG. 13 illustrates the relationship between the ratio (weight percentage) of HFO1234yf contained in the refrigerant, and pressure loss. FIG. 13 illustrates computation results in a case where about 10 HP and ϕ25.4 are used as the capacity of the air-conditioning apparatus (the capacity or output of the compressor) and the pipe diameter, respectively. The plotted points indicated by circle marks in the drawing represent computation results for a pipe (a single pipe) of ϕ25.4. The plotted points indicated by rectangular marks represent computation results for a pipe formed by connecting two pipes of ϕ25.4 in parallel. Further, broken lines represent the pressure loss of a conventional refrigerant (R410).

FIG. 13 shows that when the pipe is formed by two pipes of ϕ25.4 connected in parallel, the ratio of HFO1234yf at which the pressure loss becomes the same as that of the conventional refrigerant is approximately 75%, by the broken lines and the plotted points indicated by rectangular marks. When the ratio of HFO1234yf contained in the refrigerant becomes equal to or higher than approximately 75%, the pressure loss becomes greater than the pressure loss of the conventional refrigerant. Accordingly, in a case where the ratio of HFO1234yf contained in the refrigerant is equal to or higher than approximately 75%, the pressure loss can be made equivalent to that of the conventional refrigerant by adopting a pipe that is formed by connecting two pipes with a pipe diameter larger than ϕ25.4 in parallel.

For HFO1234ze with substantially the same physical properties as HFO1234yf as well, the pressure loss can be made equivalent to that of the conventional refrigerant by adopting a pipe that is formed by connecting two pipes with a pipe diameter larger than ϕ25.4 in parallel.

Hereinafter, the air-conditioning apparatus 100 will be described again with reference to FIG. 1.

[Outdoor Unit 200]

The outdoor unit 200 includes a compressor 201, an oil separator 202, a first flow switching device 203, a heat source side heat exchanger 204, and an accumulator 205, which are connected with the refrigerant pipes 400. The first flow switching device 203 and the accumulator 205 are partially connected with two first refrigerant pipes 207 that are connected in parallel. The suction side of the compressor 201 and the accumulator 205 are partially connected with two second refrigerant pipes 208 that are connected in parallel. The first flow switching device 203 and a refrigerant pipe 400*a* are partially connected with two third refrigerant pipes 209 that are connected in parallel. The first flow switching device 203 and the heat source-side heat exchanger 204 within the outdoor unit 200 are partially connected with two fourth refrigerant pipes 212 that are connected in parallel. Further, the oil separator 202 and the suction side of the compressor 201 are connected with an oil return capillary 206.

While each of the first to third refrigerant pipes 207 to 209 are partially configured by two pipes that are connected in parallel in the following description of the air-conditioning apparatus 100, at least one of the first to third refrigerant pipes 207 to 209 may be a refrigerant pipe configured by two pipes that are connected in parallel. That is, for example, the first refrigerant pipe 207 is configured by a single refrigerant pipe, and the second refrigerant pipe 208 and the third refrigerant pipe 209 are each configured by two pipes that are connected in parallel. Further, while the number of refrigerant pipes to be connected in parallel is two in the following description of the air-conditioning apparatus 100, the number is not particularly limited.

In a cooling operation mode, a high pressure gas refrigerant flows through the fourth refrigerant pipe 212, and accordingly, one of the two pipes thereof connected in parallel may be provided with an on-off valve (not illustrated) or the like so that the refrigerant flows through only one of the pipes. Likewise, in a heating operation mode, a high pressure gas refrigerant flows through the third refrigerant pipe 209, and accordingly, one of the two pipes thereof connected in parallel may be provided with an on-off valve (not illustrated) or the like so that the refrigerant flows through only one of the pipes.

The compressor 201 suctions the refrigerant, compresses the refrigerant into a high temperature, high pressure state, and conveys the refrigerant to a refrigerant circuit. One side of the compressor 201 is connected to the second refrigerant pipe 208, and the other side is connected to the oil separator 202 via a fifth refrigerant pipe 210. The compressor 201 may be configured by, for example, a capacity-controllable inverter compressor or the like. The oil separator 202 separates the refrigerant and refrigerating machine oil from one another. One side of the oil separator 202 is connected to the first flow switching device 203 via a sixth refrigerant pipe 211, and the other side is connected to the discharge side of the compressor 201. The first flow switching device 203 switches between the refrigerant flow in the heating operation mode and the refrigerant flow in the cooling operation mode. The first flow switching device 203 connects the sixth refrigerant pipe 211 and the third refrigerant pipe 209, and the fourth refrigerant pipe 212 and the first refrigerant pipe 207 in the heating operation mode, and connects the sixth refrigerant pipe 211 and the fourth refrigerant pipe 212, and the third refrigerant pipe 209 and the first refrigerant pipe 207 in the cooling operation mode. The first flow switching device 203 may be configured by, for example, a four-way valve or the like.

The heat source side heat exchanger (outdoor side heat exchanger) 204 functions as an evaporator during the heating operation and functions as a radiator (gas cooler) during the cooling operation, and exchanges heat between air supplied by an unillustrated air-sending device, such as a fan, and the refrigerant. One side of the heat source side heat exchanger 204 is connected to the fourth refrigerant pipe 212, and the other side is connected to the refrigerant pipe 400*b*. The heat source side heat exchanger 204 may include, for example, a plate fin and tube heat exchanger that is capable of exchanging heat between the refrigerant flowing in the refrigerant pipe and the air passing through the fins.

The accumulator 205 retains an excessive refrigerant due to a difference in the heating operation mode and the cooling operation mode and an excessive refrigerant due to a transient change in operation (change in the number of operating indoor units 300, for example). One side of the accumulator 205 is connected to the first refrigerant pipe 207, and the other side is connected to the second refrigerant pipe 208. The oil-return capillary 206 returns the refrigerating machine oil captured by the oil separator 202 to the low pressure side (side connected to the second refrigerant pipe 208) of the compressor 201. One side of the oil-return capillary 206 is connected to the oil separator 202, and the other side is connected to the second refrigerant pipe 208.

[Indoor Unit 300]

In the indoor unit 300, a use side heat exchanger (indoor side heat exchanger) and an expansion device are connected. One side of the indoor unit 300 is connected to the refrigerant pipe 400*b*, and the other side is connected to the refrigerant pipe 400*a*. The use side heat exchanger functions as a radiator in the heating operation, functions as an evaporator in the cooling operation, exchanges heat between air supplied from an unillustrated air-sending device such as a fan and the refrigerant, and generates the heating air or cooling air that is supplied to a space to be conditioned. This use-side heat exchanger may be configured by, for example, a plate fin and tube heat exchanger that is capable of exchanging heat between the refrigerant flowing through the refrigerant pipe and the air passing through fins.

The expansion device has a function as a reducing valve or an expansion valve, and decompress and expand the refrigerant. This expansion device may include a component having a variably controllable opening degree, such as an electronic expansion valve.

Embodiment 100 shows a case in which four indoor units 300 are connected. Illustrated are, from the bottom of the drawing, an indoor unit 300*a*, an indoor unit 300*b*, an indoor unit 300*c*, and an indoor unit 300*d*. In addition, the use side heat exchangers are illustrated as, from the bottom of the drawing, a use side heat exchanger 301*a*, a use side heat exchanger 301*b*, a use side heat exchanger 301*c*, and a use side heat exchanger 301*d* each corresponding to the indoor units 300*a* to 300*d*. Similarly, the expansion devices 302 are illustrated as, from the bottom of the drawing, an expansion device 302*a*, an expansion device 302*b*, an expansion device 302*c*, and an expansion device 302*d*. Note that the connected number of indoor units 300 is not limited to four. The use side heat exchangers 301*a* to 301*d* will be sometimes simply referred to as use side heat exchanger 301. The expansion devices 302*a* to 302*d* will be sometimes simply referred to as expansion device 302.

Various operation modes carried out by the air-conditioning apparatus 100 will be described below.

[Cooling Operation Mode]

Figure 2:
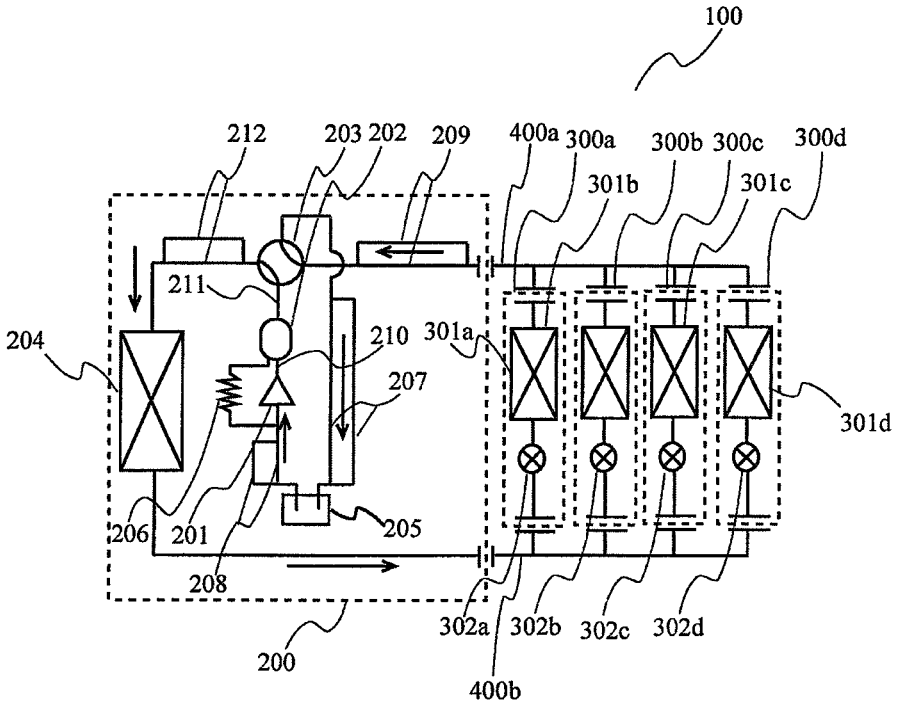
FIG. 2 illustrates a refrigerant flow in a cooling operation mode of the air-conditioning apparatus illustrated in FIG. 1.

FIG. 2 is a refrigerant circuit diagram illustrating a refrigerant flow in the cooling operation mode of the air-conditioning apparatus 100. Referring to FIG. 2, an exemplary case in which all of the indoor units 300 perform the cooling operation will be described. Note that in FIG. 2, arrows indicate the flow direction of the refrigerant.

A low temperature, low pressure refrigerant is compressed by the compressor 201 and is discharged as a high temperature, high pressure gas refrigerant therefrom. The high temperature, high pressure gas refrigerant that has been discharged from the compressor 201 flows into the oil separator 202. In the oil separator 202, the refrigerant and the refrigerating machine oil that is mixed in the refrigerant are separated. The separated refrigerating machine oil passes through the oil return capillary 206 and returns to the low pressure side of the compressor 201, and returns to the compressor 201. The high temperature, high pressure refrigerant separated in the oil separator 202 flows into the heat source side heat exchanger 204 via the sixth refrigerant pipe 211, the first flow switching device 203, and the fourth refrigerant pipe 212.

The high temperature, high pressure gas refrigerant that has flowed into the heat source side heat exchanger 204 exchanges heat with the air supplied from the unillustrated air-sending device and, thus, transfers heat to the air. The high temperature, high pressure gas refrigerant that has flowed into the heat source side heat exchanger 204 turns into a liquid state and flows out from the heat source side heat exchanger 204. This refrigerant in the liquid state flows into the indoor units 300*a* to 300*d* via the refrigerant pipe 400*b*.

The refrigerant in the liquid state that has flowed into the indoor units 300*a* to 300*d* is expanded (decompressed) by of the expansion devices 302*a* to 302*d*, respectively, and turns into a low temperature, low pressure refrigerant in a two-phase gas-liquid gas state. This refrigerant in the two-phase gas-liquid gas state flows into each of the use side heat exchangers 301*a* to 301*d*. The refrigerant in the two-phase gas-liquid state that has flowed into the use side heat exchangers 301*a* to 301*d* exchanges heat with air (indoor air) supplied from the unillustrated air-sending device to thereby remove heat from the air, turns into a low pressure gas refrigerant, and flows out from the use side heat exchangers 301*a* to 301*d*.

Although not illustrated in FIG. 2, normally, temperature sensors are provided at the refrigerant inlet and outlet of the use side heat exchanger 301. The amount of refrigerant supplied to the use side heat exchanger 301 is controlled on the basis of temperature information from the temperature sensors. Specifically, the amount of refrigerant supplied to the use side heat exchanger 301 is controlled by computing the degree of superheat (the refrigerant temperature on the outlet side minus the refrigerant temperature at the inlet) on the basis of the information from those temperature sensors, and setting the opening degree of the expansion device 302 so that the degree of superheat is about 2 to 5 degrees C.

The flows of the refrigerant that have flowed out from the use side heat exchangers 301*a* to 301*d* flow out from the indoor units 300*a* to 300*d*, respectively, and merge in the refrigerant pipe 400*a*. Thereafter, this low pressure gas refrigerant flows into the outdoor unit 200 via the refrigerant pipe 400*a*. The refrigerant that has flowed into the outdoor unit 200 flows into the accumulator 205 via the third refrigerant pipe 209, the first flow switching device 203, and the first refrigerant pipe 207. At this time, the low pressure gas refrigerant turns into a two-phase gas-liquid gas state as the refrigerant flows through the refrigerant pipe 400*a*, the third refrigerant pipe 209, the first flow switching device 203, and the first refrigerant pipe 207. The refrigerant that has flowed into the accumulator 205 is separated into a liquid refrigerant and a gas refrigerant, and the gas refrigerant flows into the compressor 201 via the second refrigerant pipe 208.

In the cooling operation mode of the air-conditioning apparatus 100, the degree of superheat is controlled in the indoor unit 300, thereby preventing the refrigerant in a liquid state from flowing into the accumulator 205. However, during transient operation or when there is a suspended indoor unit 300, there are cases in which a small amount of refrigerant in a liquid state (approximately 0.95 of dryness) flows into the accumulator 205. The liquid refrigerant that has flowed into the accumulator 205 evaporates and is suctioned into the compressor 201, or is suctioned into the compressor 201 through an oil return hole (not illustrated) provided in the outlet pipe of the accumulator 205.

[Heating Operation Mode]

Figure 3:
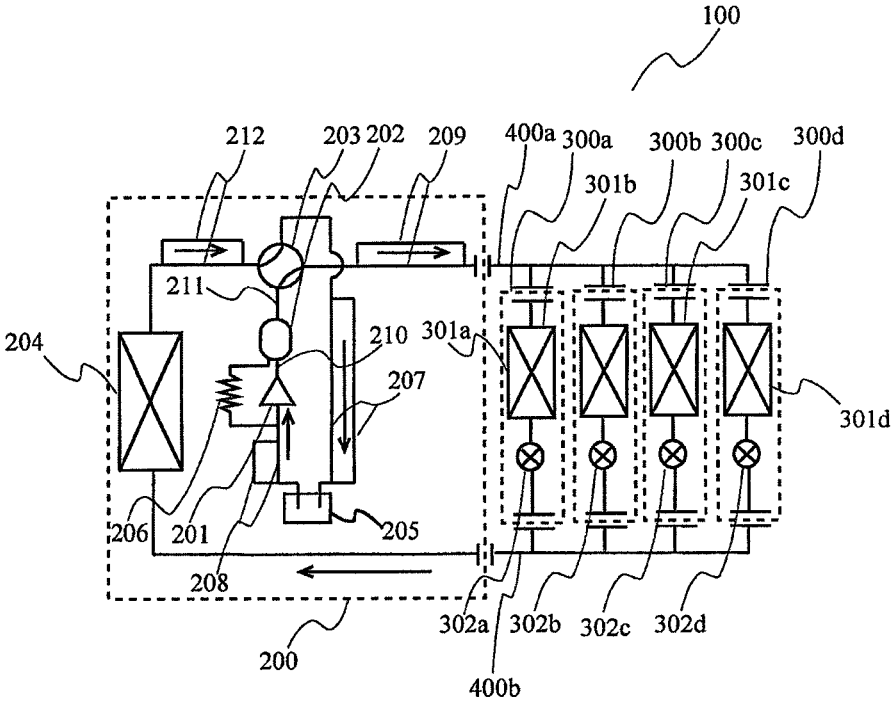
FIG. 3 illustrates a refrigerant flow in a heating operation mode of the air-conditioning apparatus illustrated in FIG. 1.

FIG. 3 is a refrigerant circuit diagram illustrating a refrigerant flow in the heating operation mode of the air-conditioning apparatus 100. Referring to FIG. 3, an exemplary case in which all of the indoor units 300 perform the cooling operation will be described. Note that in FIG. 3, arrows indicate the flow direction of the refrigerant.

A low temperature, low pressure refrigerant is compressed by the compressor 201 and is discharged as a high temperature, high pressure gas refrigerant therefrom. The high temperature, high pressure gas refrigerant that has been discharged from the compressor 201 flows into the oil separator 202. In the oil separator 202, the refrigerant and the refrigerating machine oil that is mixed in the refrigerant are separated. The separated refrigerating machine oil passes through the oil return capillary 206 and returns to the low pressure side of the compressor 201, and returns to the compressor 201. The high temperature, high pressure refrigerant separated in the oil separator 202 flows into the indoor units 300*a* to 300*d* via the sixth refrigerant pipe 211, the first flow switching device 203, the third refrigerant pipe 209, and the refrigerant pipe 400*a*.

The high temperature, high pressure gas refrigerant that has flowed into the indoor units 300*a* to 300*d* exchanges heat with air (indoor air) supplied from the unillustrated air-sending device in the use side heat exchangers 301*a* to 301*d*, thereby transferring heat to the air, and turns into a liquid state and flows out from the use side heat exchangers 301*a* to 301*d*. This high pressure refrigerant in a liquid state is expanded (decompressed) in each of the expansion devices 302*a* to 302*d*, turns into a low temperature, low pressure refrigerant in a two-phase gas-liquid state, and flows out from the indoor units 300*a* to 300*d*.

Although not illustrated in FIG. 3, normally, a temperature sensor and a pressure sensor are provided at each of the refrigerant outlets of the use side heat exchangers 301*a* to 301*d*. Further, the refrigerant amount supplied to the use side heat exchanger 301 is controlled on the basis of the information from the temperature sensor and the pressure sensor provided in the refrigerant outlet of the use side heat exchanger 301. Specifically, the amount of refrigerant supplied to the use side heat exchanger 301 is controlled by computing the degree of subcooling (the saturation temperature converted from the detected pressure of refrigerant on the outlet side minus the refrigerant temperature on the outlet side) on the basis of information from those sensors, and setting the opening degree of the expansion device 302 so that the degree of subcooling is about 2 to 5 degrees C.

The flows of the refrigerant in a two-phase gas-liquid gas state that have flowed out from the use side heat exchangers 301*a* to 301*d* flow out from the indoor units 300*a* to 300*d*, and merge in the refrigerant pipe 400*b*. Thereafter, this refrigerant in a two-phase gas-liquid state flows into the outdoor unit 200 via the refrigerant pipe 400*b*. The refrigerant that has flowed into the outdoor unit 200 flows into the heat source side heat exchanger 204, where the refrigerant removes heat from air (indoor air) supplied from the unillustrated air-sending device and turns into a low pressure gas refrigerant, and flows out from the heat source side heat exchanger 204.

The low pressure gas refrigerant that has flowed out from the heat source side heat exchanger 204 flows into the accumulator 205 via the fourth refrigerant pipe 212, the first flow switching device 203, and the first refrigerant pipe 207. At this time, the low pressure gas refrigerant turns into a two-phase gas-liquid gas state as the refrigerant flows through the fourth refrigerant pipe 212, the first flow switching device 203, and the first refrigerant pipe 207. The refrigerant that has flowed into the accumulator 205 is separated into a liquid refrigerant and a gas refrigerant, and the gas refrigerant flows into the compressor 201 via the second refrigerant pipe 208.

In the heating operation mode of the air-conditioning apparatus 100, there is the excess refrigerant in the accumulator 205 all the time. The liquid refrigerant that has flowed into the accumulator 205 evaporates and is suctioned into the compressor 201, or is suctioned into the compressor 201 through the unillustrated oil return hole provided in the outlet pipe of the accumulator 205.

[Advantageous Effects of Air-Conditioning Apparatus 100]

FIG. 10 shows density at 0 degrees C. of a HFO1234yf refrigerant and a R410A refrigerant. FIG. 11 shows refrigerant pipe diameters in a case where two refrigerant pipes are substituted for a single refrigerant pipe of a predetermined diameter, at various outputs of a compressor. The air-conditioning apparatus 100 adopts HFO1234yf or the like having a small global warming potential. The density in a low pressure state of this HFO1234yf refrigerant will be described. Compared to a R410A refrigerant which is currently used in many air-conditioning apparatuses, the gas density in a low pressure state of a HFO1234yf refrigerant is about ½. For example, the gas density at 0 degrees C. is as illustrated in FIG. 10. The flow velocity at which this HFO1234yf refrigerant having a small gas density in a low pressure state flows through a refrigerant pipe is approximately twice compared to R410A, provided that the refrigerants flow through a refrigerant pipe of the same diameter. Further, it is known that pressure loss is roughly proportional to the square of flow velocity. Hence, the pressure loss of the HFO1234yf refrigerant becomes approximately four times larger than that of the R410A refrigerant, which reduces the energy efficiency of the air-conditioning apparatus 100.

In the case of a room air-conditioning apparatus with a small refrigerant circuit configuration (system capacity), making the refrigerant pipe diameter twice as large does not frequently presents problems in terms of machining because the original pipe diameter is small. However, in the case of a multi-air-conditioning apparatus for an office building with a large refrigerant circuit configuration which is installed in a large structure such as an office building, for example, if the refrigerant pipe diameter is twice as large as the refrigerant pipe diameter adopted for the R410A refrigerant, the refrigerant pipe diameter becomes ϕ44.5 in some cases. Bending a refrigerant pipe with such a large diameter significantly increases the machining cost of the air-conditioning apparatus 100. Moreover, because a refrigerant pipe with such a large diameter is rarely used in the market, the cost of the refrigerant pipe itself becomes also high, thus increasing the production cost.

In the air-conditioning apparatus 100, instead of using a refrigerant pipe with a large diameter for the refrigerant pipe through which a refrigerant in a low pressure state flows, two refrigerant pipes (corresponding to the first to third refrigerant pipes 207 to 209) are placed in parallel, thereby providing performance equivalent to that of the refrigerant pipe with a large diameter. In comparison to a refrigerant pipe with a large diameter, two refrigerant pipes placed in parallel are easy to machine, thereby reducing the machining cost. Moreover, in comparison to a refrigerant pipe with a large diameter, the cost of the refrigerant pipes themselves is also low, thereby reducing the production cost.

Now, as an example, assuming that S1 is the cross-sectional area of a refrigerant pipe of ϕ44.5 mm (pipe diameter D1), and S2 is the cross-sectional area of two parallel refrigerant pipes (pipe diameter D2), the refrigerant pipe diameter is determined so as to satisfy Equation (1).

$$S1=2\times S2 \quad (1)$$

Expressing Equation (1) with respect to the pipe diameter D2 yields Equation (2).

$$D2=D1\times 2-0.5 \quad (2)$$

Therefore, to provide performance equivalent to that of the refrigerant pipe with a diameter of ϕ44.5 mm with two parallel refrigerant pipes, the diameter of each pipe may be set to ϕ31.5 mm. FIG. 11 illustrates the relationship between the system capacity of the air-conditioning unit 100, the pipe D1, and the pipe diameter D2 for obtaining performance equivalent to D1 by using two pipes.

In this way, the air-conditioning apparatus 100 is provided with the first to third refrigerant pipes 207 to 209 each of which are partially configured by two pipes connected in parallel (a plurality of pipes in parallel). Therefore, even when a low pressure refrigerant such as HFO1234yf is adopted, pressure loss of the refrigerant can be reduced while suppressing the machining cost and manufacturing cost of the air-conditioning apparatus 100. Moreover, because the diameter of the first to third refrigerant pipes 207 to 209 is not made large, the bending radius of the first to third refrigerant pipes 207 to 209 can be made small, thereby making the air-conditioning apparatus 100 compact.

As the refrigerant, use of HFO1234ze that is the same tetrafluoropropene-based refrigerant can also provide the same effect as HFO1234yf.

Embodiment 2

Figure 4:
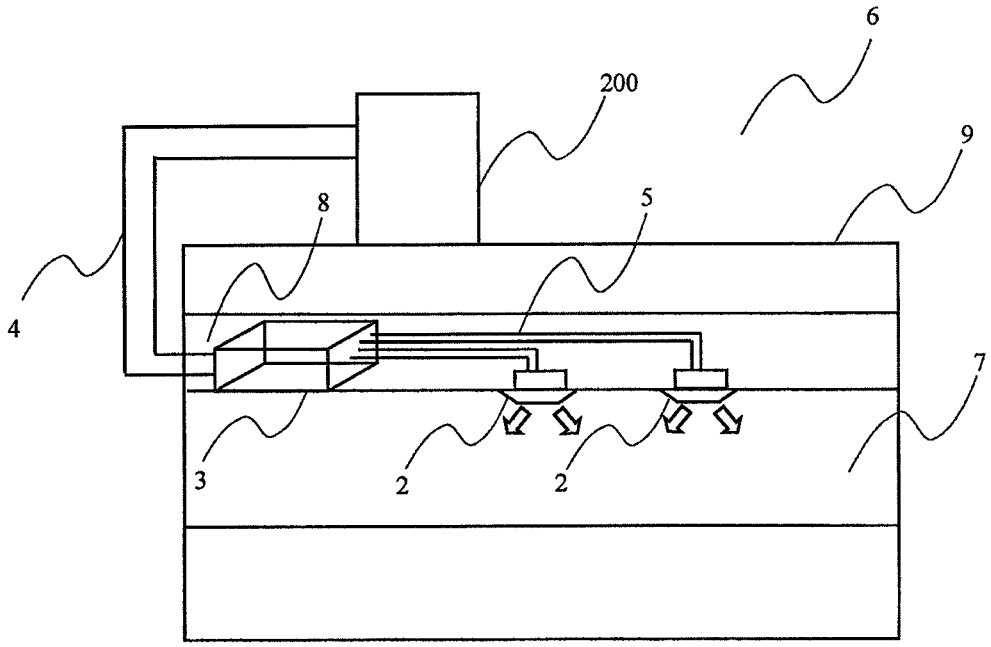
FIG. 4 is a schematic diagram illustrating an exemplary installation of an air-conditioning apparatus according to Embodiment 2 of the invention.

FIG. 4 is a schematic diagram illustrating an exemplary installation of an air-conditioning apparatus according to Embodiment 2 of the invention. The exemplary installation of the air-conditioning apparatus will be described with reference to FIG. 4. This air-conditioning apparatus has a refrigerant circuit A (see FIGS. 5 to 9) that is a refrigeration cycle that circulates a heat source side refrigerant, and a heat medium circuit B (see FIGS. 5 to 9) that is a refrigeration cycle (second refrigeration cycle) that circulates a heat medium. The air-conditioning apparatus allows each indoor unit to select a cooling mode or a heating mode as an operation mode. Note that in Embodiment 2, differences to those of Embodiment 1 will be mainly described, and same parts as Embodiment 1 will be referred to with the same reference numerals and description thereof will be omitted.

While the air-conditioning apparatus 100 adopts a system that takes advantage of the cooling energy or the heating energy of the refrigerant as it is (direct expansion system), the air-conditioning apparatus according to Embodiment 2 adopts a system that transfers the cooling energy or the heating energy of a heat source side refrigerant to a heat medium for use (indirect system). That is, air-conditioning apparatus according to Embodiment 2 transfers the cooling energy or the heating energy stored in the heat source side refrigerant to the heat medium different from the heat source side refrigerant, and cools or heats the space to be conditioned by this cooling energy or heating energy transferred to the heat medium.

As illustrated in FIG. 4, the air-conditioning apparatus according to Embodiment 2 has a single outdoor unit 200 that is a heat source unit, a plurality of indoor units 2, and a heat medium relay unit 3 for transferring the cooling energy or heating energy of the heat source side refrigerant flowing through the outdoor unit 200 to the heat medium flowing through the indoor units 2. The heat medium relay unit 3 exchanges heat between the heat source side refrigerant and the heat medium. The outdoor unit 200 is connected to the heat medium relay unit 3 with refrigerant pipes 4 through which the heat source side refrigerant flows. The heat medium relay unit 3 and each indoor unit 2 are connected with the heat medium pipes 5 through which the heat medium is conveyed. Cooling energy or heating energy generated in the outdoor unit 200 is transferred to the heat medium in the heat medium relay unit 3 and delivered to the indoor units 2.

The outdoor unit 200 is typically disposed in an outdoor space 6 which is a space (e.g., a roof) outside of a structure 9, such as an office building, and is configured to supply cooling energy or heating energy through the heat medium relay unit 3 to the indoor units 2. Each indoor unit 2 is disposed at a position such that it can supply cooling air or heating air to an indoor space 7, which is a space (e.g., a living room) inside of the structure 9, and is configured to supply the cooling air or heating air to the indoor space 7, as a space to be conditioned. The heat medium relay unit 3 is configured with a housing separate from the outdoor unit 200 and the indoor units 2 such that the heat medium relay unit 3 can be disposed at a position different from those of the outdoor space 6 and the indoor space 7, and is connected to the outdoor unit 200 through the refrigerant pipes 4 and is connected to the indoor units 2 through the heat medium pipes 5 to convey cooling energy or heating energy, supplied from the outdoor unit 200 to the indoor units 2.

As illustrated in FIG. 4, in the air-conditioning apparatus according to Embodiment 2, the outdoor unit 200 is connected to the heat medium relay unit 3 with refrigerant pipes 4, and the heat medium relay unit 3 is connected to each indoor unit 2 with heat medium pipes 5. As described above, in the air-conditioning apparatus according to Embodiment 2, each of the units (the outdoor unit 200, the indoor units 2, and the heat medium relay unit 3) is connected with the refrigerant pipes 4 or the heat medium pipes 5), thus construction is facilitated.

Furthermore, FIG. 4 illustrates an exemplary state in which the heat medium relay unit 3 is disposed in the structure 9 but in a space different from the indoor space 7, for example, a space above a ceiling (for example, a space above a ceiling in the structure 9, hereinafter, simply referred to as a "space 8"). The heat medium relay unit 3 can be disposed in other spaces, such as a common space where an elevator or the like is installed. In addition, although FIG. 4 illustrates a case in which the indoor unit 2 is of a ceiling cassette type, the indoor unit is not limited to this type and, for example, a ceiling-concealed type, a ceiling-suspended type, or any type of indoor unit may be used as long as the unit can supply heating air or cooling air to the indoor space 7 directly or through a duct or the like.

FIG. 4 illustrates a case in which the outdoor unit 200 is disposed in the outdoor space 6. The arrangement is not limited to this case. For example, the outdoor unit 200 may be disposed in an enclosed space, for example, a machine room with a ventilation opening, may be disposed inside of the structure 9 as long as waste heat can be exhausted through an exhaust duct to the outside of the structure 9, or may also be disposed inside of the structure 9 in the use of the outdoor unit 200 of a water-cooled type.

The heat medium relay unit 3 may be installed at a position near the outdoor unit 200 and far from the indoor units 2. However, the heat medium relay unit 3 may be installed with consideration to that when the distance from the heat medium relay unit 3 to the indoor units 2 is long, because power (energy) necessary for conveying the heat medium is significantly large, the advantageous effect of energy saving is reduced. Further, the number of the outdoor units 200, indoor units 2, and heat medium relay units 3 to be connected is not particularly limited, and the number may be determined in accordance with the structure 9.

Figure 5:
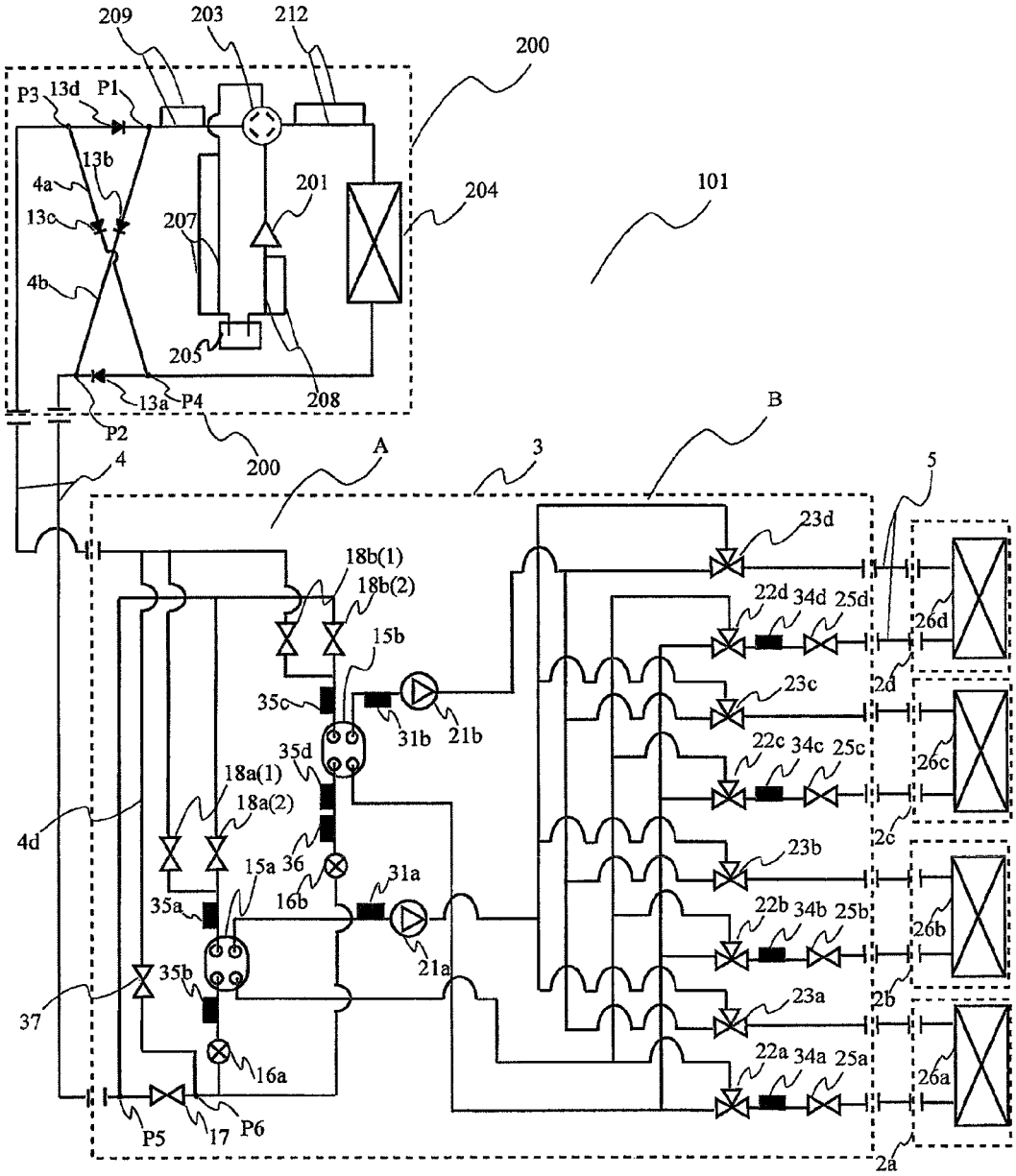
FIG. 5 illustrates an exemplary refrigerant circuit configuration of the air-conditioning apparatus according to Embodiment 2 of the invention.

FIG. 5 is a schematic circuit diagram illustrating an exemplary refrigerant circuit configuration of an air-conditioning apparatus 101 according to Embodiment 2. The refrigerant circuit configuration of the air-conditioning apparatus 101 will be now be described referring to FIG. 5. As illustrated in FIG. 5, the outdoor unit 200 is connected to a heat exchanger 15*a* related to heat medium and a heat exchanger 15*b* related to heat medium that are provided in the heat medium relay unit 3 via the refrigerant pipes 4. The heat exchanger 15*a* related to heat medium and the heat exchanger 15*b* related to heat medium are connected to indoor units 2*a* to 2*d* (hereinafter, sometimes also simply referred to as indoor unit 2) via the heat medium pipes 5. The refrigerant pipes 4 and the heat medium pipes 5 will be described later.

[Outdoor Unit 200]

The outdoor unit 200 includes a compressor 201, a flow switching device 203, a heat source side heat exchanger 204, and an accumulator 205, which are connected with each refrigerant pipe to be described later. The first flow switching device 203 and the accumulator 205 are partially connected with two first refrigerant pipes 207 that are connected in parallel. The suction side of the compressor 201 and the accumulator 205 are partially connected with two second refrigerant pipes 208 that are connected in parallel. The first flow switching device 203 and the heat source side heat exchanger 204 are partially connected with two fourth refrigerant pipes 212 that are connected in parallel. Further, the refrigerant pipes 4 and the first flow switching device 203 within the outdoor unit 200 are partially configured by two third refrigerant pipes 209 that are connected in parallel. The outdoor unit 200 according to Embodiment 2 will be described as not being provided with the oil separator 202 and the oil-return capillary 206 that are provided in the air-conditioning apparatus 100.

The outdoor unit 200 further includes a first connection pipe 4*a*, a second connection pipe 4*b*, a check valve 13*a*, a check valve 13*b*, a check valve 13*c*, and a check valve 13*d*. Such an arrangement of the first connection pipe 4*a*, the second connection pipe 4*b*, the check valve 13*a*, the check valve 13*b*, the check valve 13*c*, and the check valve 13*d* enables the heat source side refrigerant, allowed to flow into the heat medium relay unit 3, to flow in a constant direction irrespective of an operation requested by any indoor unit 2.

In a cooling only operation mode and a cooling main operation mode which will be described later, a high pressure gas refrigerant flows through the fourth refrigerant pipe 212, and accordingly, one of the two pipes thereof connected in parallel may be provided with an on-off valve (not illustrated) or the like so that the refrigerant flows through only one of the pipes. Likewise, in a heating only operation mode and a heating main operation mode, a high pressure gas refrigerant flows through the third refrigerant pipe 209, and accordingly, one of the two pipes thereof connected in parallel may be provided with an on-off valve (not illustrated) or the like so that the refrigerant flows through only one of the pipes.

[Indoor Units 2]

The indoor units 2 are provided with use side heat exchangers 26*a* to 26*d* (sometimes also simply referred to as use side heat exchanger 26). The use side heat exchangers 26 are connected to heat medium flow control devices 25*a* to 25*d* (sometimes also simply referred to as heat medium flow control device 25) via the heat medium pipes 5, and second heat medium flow switching devices 23*a* to 23*d* (sometimes also simply referred to as second heat medium flow switching device 23) via the heat medium pipes 5. The use side heat exchanger 26 is configured to exchange heat between air supplied from an air-sending device, such as an unillustrated fan, and the heat medium in order to generate heating air or cooling air to be supplied to the indoor space 7.

FIG. 5 illustrates a case where four indoor units 2*a* to 2*d* are connected to the heat medium relay unit 3 via the heat medium pipes 5. In addition, the use side heat exchangers 26 are illustrated as, from the bottom of the drawing, the use side heat exchanger 26*a*, the use side heat exchanger 26*b*, the use side heat exchanger 26*c*, and the use side heat exchanger 26*d* each corresponding to the indoor units 2*a* to 2*d*. Note that the connected number of indoor units 2 is not limited to four.

[Heat Medium Relay Unit 3]

The heat medium relay unit 3 is equipped with two heat exchangers 15*a* and 15*b* related to heat medium (sometimes also simply referred to as heat exchanger 15 related to heat medium), two expansion devices 16*a* and 16*b* (sometimes also simply referred to as expansion device 16), two opening and closing devices 17 and 37, four second flow switching devices 18*a*(1), 18*a*(2), 18*b*(1), and 18*b*(2) (sometimes also simply referred to as second flow switching device 18), two pumps 21*a* and 21*b* (sometimes also simply referred to as pump 21), four first heat medium flow switching devices 22*a* to 22*d* (sometimes also simply referred to as first heat medium flow switching device 22), four second heat medium flow switching devices 23*a* to 23*d* (sometimes also simply referred to as second heat medium flow switching device 23), and four heat medium flow control devices 25*a* to 25*d* (sometimes also simply referred to as heat medium flow control device 25).

Each of the two heat exchangers 15 related to heat medium functions as a condenser (radiator) or an evaporator and exchanges heat between the heat source side refrigerant and the heat medium in order to transfer cooling energy or heating energy, generated in the outdoor unit 200 and stored in the heat source side refrigerant, to the heat medium. The heat exchanger 15*a* related to heat medium is disposed between the expansion device 16*a* and a pipe, connecting the second flow switching device 18*a*(1) and the second flow switching device 18*a*(2), and is connected to them in the refrigerant circuit A in order to cool the heat medium in a cooling and heating mixed operation mode. The heat exchanger 15*b* related to heat medium is disposed between the expansion device 16*b* and a pipe, connecting the second flow switching device 18*b*(1) and the second flow switching device 18*b*(2), and is connected to them in the refrigerant circuit A in order to heat the heat medium in the cooling and heating mixed operation mode.

The two expansion devices 16 each have functions as a reducing valve and an expansion valve and are configured to decompress and expand the heat source side refrigerant. The expansion device 16*a* is disposed upstream from the heat exchanger 15*a* related to heat medium in the flow direction of the heat source side refrigerant during the cooling only operation mode. The expansion device 16*b* is disposed upstream from the heat exchanger 15*b* related to heat medium in the flow direction of the heat source side refrigerant during the cooling only operation mode. Each of the two expansion devices 16 may include a component having a variably controllable opening degree, for example, an electronic expansion valve.

The opening and closing device 17 and the second opening and closing device 37 are each configured by a two-way valve or the like, and open and close the refrigerant pipe 4. The opening and closing device 17 is provided in the refrigerant pipe 4 between Point 5 and Point 6. The second opening and closing device 37 is provided in a pipe 4*d* that provides a bypass between a pipe on the side where the heat source side refrigerant circulates in a high pressure state, and a pipe on the side where the heat source side refrigerant circulates in a low pressure state, within the heat medium relay unit 3.

Figure 12:
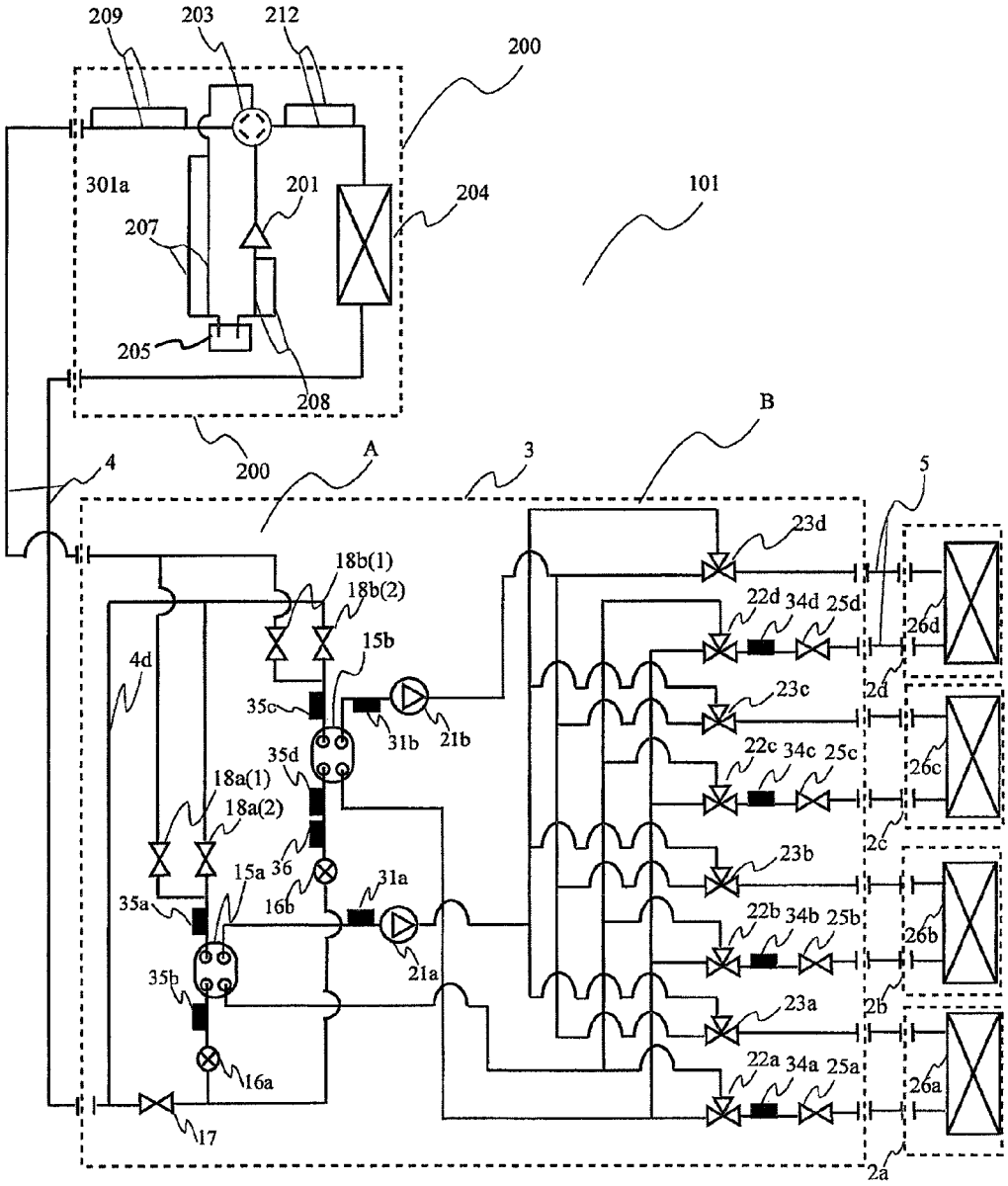
FIG. 12 illustrates another exemplary refrigerant circuit configuration of the air-conditioning apparatus according to Embodiment 2 of the invention.

FIG. 12 illustrates other exemplary refrigerant circuit configuration of the air-conditioning apparatus 101 according to Embodiment 2 of the invention than that of FIG. 5. While the following description of FIG. 5 assumes that the first connection pipe 4*a*, the second connection pipe 4*b*, the check valve 13*a*, the check 13*b*, the check valve 13*d*, the pipe 4*d*, and the opening and closing device 37 mentioned above are provided, the cooling and heating mixed operation can be performed even in the case of the refrigerant circuit configuration as illustrated in FIG. 12 in which these components are not provided. Hereinafter, the air-conditioning apparatus 101 will be described again with reference to FIG. 5.

The four second flow switching devices 18 each include, for example, a four-way valve and switch passages of the heat source side refrigerant in accordance with the operation mode. The second flow switching devices 18*a*(1), 18*b*(2) are disposed downstream from the heat exchanger 15*a* related to heat medium in the flow direction of the heat source side refrigerant during the cooling only operation mode. The second flow switching devices 18*b*(1), 18*b*(2) are disposed downstream from the heat exchanger 15*b* related to heat medium in the flow direction of the heat source side refrigerant during the cooling only operation mode.

The two pumps 21 circulate the heat medium flowing through the heat medium pipes 5. The pump 21*a* is disposed in the pipe 5 which connects the heat exchanger 15*a* related to heat medium and the second heat medium flow switching devices 23. The pump 21*b* is disposed in the pipe 5 which connects the heat exchanger 15*b* related to heat medium and the second heat medium flow switching devices 23. Each of the two pumps 21 may include, for example, a capacity-controllable pump. Note that the pump 21*a* may be provided in the pipe 5 which connects the heat exchanger 15*a* related to heat medium and the first heat medium flow switching devices 22. Furthermore, the pump 21*b* may be provided in the pipe 5 which connects the heat exchanger 15*b* related to heat medium and the first heat medium flow switching devices 22.

The four first heat medium flow switching devices 22 each include, for example, a three-way valve and switch passages of the heat medium. The first heat medium flow switching devices 22 are arranged so that the number thereof (four in this case) corresponds to the installed number of indoor units 2. Each first heat medium flow switching device 22 is disposed on an outlet side of a heat medium passage of the corresponding use side heat exchanger 26 such that one of the three ways is connected to the heat exchanger 15*a* related to heat medium, another one of the three ways is connected to the heat exchanger 15*b* related to heat medium, and the other one of the three ways is connected to the corresponding heat medium flow control device 25. Further, illustrated from the bottom of the drawing are the first heat medium flow switching device 22*a*, the first heat medium flow switching device 22*b*, the first heat medium flow switching device 22*c*, and the first heat medium flow switching device 22*d*, so as to correspond to the respective indoor units 2.

The four second heat medium flow switching devices 23 each include, for example, a three-way valve and switch passages of the heat medium. The second heat medium flow switching devices 23 are arranged so that the number thereof (four in this case) corresponds to the installed number of indoor units 2. Each second heat medium flow switching device 23 is disposed on an inlet side of the heat medium passage of the corresponding use side heat exchanger 26 such that one of the three ways is connected to the heat exchanger 15*a* related to heat medium, another one of the three ways is connected to the heat exchanger 15*b* related to heat medium, and the other one of the three ways is connected to the corresponding use side heat exchanger 26. Further, illustrated from the bottom of the drawing are the second heat medium flow switching device 23*a*, the second heat medium flow switching device 23*b*, the second heat medium flow switching device 23*c*, and the second heat medium flow switching device 23*d*, so as to correspond to the respective indoor units 2.

The four heat medium flow control devices 25 each include, for example, a two-way valve capable of controlling the area of opening and controls the flow rate of the heat medium flowing in each heat medium pipe 5. The heat medium flow control devices 25 are arranged so that the number thereof (four in this case) corresponds to the installed number of indoor units 2. Each heat medium flow control device 25 is disposed on the outlet side of the heat medium passage of the corresponding use side heat exchanger 26 such that one way is connected to the use side heat exchanger 26 and the other way is connected to the first heat medium flow switching device 22. Furthermore, illustrated from the bottom of the drawing are the heat medium flow control device 25*a*, the heat medium flow control device 25*b*, the heat medium flow control device 25*c*, and the heat medium flow control device 25*d* so as to correspond to the respective indoor units 2. In addition, each of the heat medium flow control devices 25 may be disposed on the inlet side of the heat medium passage of the corresponding use side heat exchanger 26.

The heat medium relay unit 3 includes various detecting means (referring to FIG. 5, two first temperature sensors 31*a* and 31*b*, four second temperature sensors 34*a* to 34*d*, four third temperature sensors 35*a* to 35*d*, and a pressure sensor 36). Information (temperature information and pressure information) detected by these various detecting means is transmitted to a controller (not illustrated) that performs integrated control of the operation of the air-conditioning apparatus 101 such that the information is used to control, for example, the driving frequency of the compressor 201, the rotation speed of the unillustrated air-moving devices disposed near the heat source side heat exchanger 204 and the use side heat exchangers 26, switching of the first flow switching device 203, the driving frequency of the pumps 21, switching of the second flow switching devices 18, and switching of passages of the heat medium.

Each of the two first temperature sensors 31*a* and 31*b* (sometimes also simply referred to as first temperature sensor 31) detects the temperature of the heat medium flowing out of the corresponding heat exchanger 15 related to heat medium, namely, the temperature of the heat medium at an outlet of the corresponding heat exchanger 15 related to heat medium and may include, for example, a thermistor. The first temperature sensor 31*a* is disposed in the heat medium pipe 5 on the inlet side of the pump 21*a*. The first temperature sensor 31*b* is disposed in the heat medium pipe 5 on the inlet side of the pump 21*b*.

Each of the four second temperature sensors 34*a* to 34*d* (sometimes also simply referred to as second temperature sensor 34) is disposed between the corresponding first heat medium flow switching device 22 and heat medium flow control device 25 and detects the temperature of the heat medium flowing out of each use side heat exchanger 26. A thermistor or the like may be used as the second temperature sensor 34. The second temperature sensors 34 are arranged so that the number thereof (four in this case) corresponds to the installed number of indoor units 2. Note that the second temperature sensor 34*a*, the second temperature sensor 34*b*, the second temperature sensor 34*c*, and the second temperature sensor 34*d* are illustrated in that order from the bottom of the drawing sheet so as to correspond to the indoor units 2.

Each of the four third temperature sensors 35*a* to 35*d* (sometimes also simply referred to as third temperature sensor 35) is disposed on the inlet side or the outlet side of the heat source side refrigerant of the heat exchanger 15 related to heat medium and detects the temperature of the heat source side refrigerant flowing into the heat exchanger 15 related to heat medium or the temperature of the heat source side refrigerant which has flowed out of the heat exchanger 15 related to heat medium and may include, for example, a thermistor. The third temperature sensor 35*a* is disposed between the heat exchanger 15*a* related to heat medium and the second flow switching device 18*a*. The third temperature sensor 35*b* is disposed between the heat exchanger 15*a* related to heat medium and the expansion device 16*a*. The third temperature sensor 35*c* is disposed between the heat exchanger 15*b* related to heat medium and the second flow switching device 18*b*. The third temperature sensor 35*d* is disposed between the heat exchanger 15*b* related to heat medium and the expansion device 16*b*.

The pressure sensor 36 is disposed between the heat exchanger 15*b* related to heat medium and the expansion device 16*b*, similar to the installed position of the third temperature sensor 35*d*, and is configured to detect a pressure of the heat source side refrigerant flowing between the heat exchanger 15*b* related to heat medium and the expansion device 16*b*.

Furthermore, the unillustrated controller includes a microcomputer and the like and controls, for example, the driving frequency of the compressor 201, the rotation speed (including ON/OFF) of each air-sending device, switching of the first flow switching device 203, driving of the pumps 21, the opening degree of each expansion device 16, opening and closing of each opening and closing device 17, switching of the second flow switching devices 18, switching of the first heat medium flow switching devices 22, switching of the second heat medium flow switching devices 23, and the opening degree of the heat medium flow control devices 25 on the basis of the information detected by the various detecting means and instructions from a remote controller in order to carry out any of the operation modes which will be described later. Note that the controller may be provided to each unit, or may be provided to the outdoor unit 200 or the heat medium relay unit 3.

The heat medium pipes 5 in which the heat medium flows include the pipe connected to the heat exchanger 15*a* related to heat medium and the pipe connected to the heat exchanger 15*b* related to heat medium. Each heat medium pipe 5 is branched (into four in this case) in accordance with the number of indoor units 2 connected to the heat medium relay unit 3. The heat medium pipes 5 are connected with the first heat medium flow switching devices 22 and the second heat medium flow switching devices 23. Controlling each first heat medium flow switching device 22 and each second heat medium flow switching device 23 determines whether the heat medium flowing from the heat exchanger 15*a* related to heat medium is allowed to flow into the corresponding use side heat exchanger 26 and whether the heat medium flowing from the heat exchanger 15*b* related to heat medium is allowed to flow into the corresponding use side heat exchanger 26.

In the air-conditioning apparatus 101, the compressor 201, the first flow switching device 203, the heat source side heat exchanger 204, the opening and closing device 17, the expansion devices 16, refrigerant passages of the heat exchangers 15 related to heat medium on the heat medium side, the second flow switching devices 18, and the accumulator 205 are connected through the refrigerant pipes 4, thus forming the refrigerant circuit A. In addition, heat medium passages of the heat exchangers 15 related to heat medium, the pumps 21, the first heat medium flow switching devices 22, the heat medium flow control devices 25, the use side heat exchangers 26, and the second heat medium flow switching devices 23 are connected by the heat medium pipes 5, thus forming the heat medium circuits B. In other words, the plurality of use side heat exchangers 26 are connected in parallel to each of the heat exchangers 15 related to heat medium, thus turning the heat medium circuit B into a multi-system.

Accordingly, in the air-conditioning apparatus 101, the outdoor unit 200 and the heat medium relay unit 3 are connected through the heat exchanger 15*a* related to heat medium and the heat exchanger 15*b* related to heat medium arranged in the heat medium relay unit 3. The heat medium relay unit 3 and each indoor unit 2 are also connected through the heat exchanger 15*a* related to heat medium and the heat exchanger 15*b* related to heat medium. In other words, in the air-conditioning apparatus 101, the heat exchanger 15*a* related to heat medium and the heat exchanger 15*b* related to heat medium each exchange heat between the heat source side refrigerant circulating in the refrigerant circuit A and the heat medium circulating in the heat medium circuits B.

The air-conditioning apparatus 101 allows each indoor unit 2, on the basis of an instruction from the indoor unit 2, to perform a cooling operation or a heating operation. Specifically, the air-conditioning apparatus 101 may allow all of the indoor units 2 to perform the same operation and also allow each of the indoor units 2 to perform different operations.

Various operation modes executed by the air-conditioning apparatus 101 will now be described.

The operation modes carried out by the air-conditioning apparatus 101 includes a cooling only operation mode in which all of the operating indoor units 2 perform the cooling operation, a heating only operation mode in which all of the operating indoor units 2 perform the heating operation, a cooling main operation mode that is a cooling and heating mixed operation mode in which cooling load is larger, and a heating main operation mode that is a cooling and heating mixed operation mode in which heating load is larger. The operation modes will be described below with respect to the flow of the heat source side refrigerant and that of the heat medium.

[Cooling Only Operation Mode]

Figure 6:
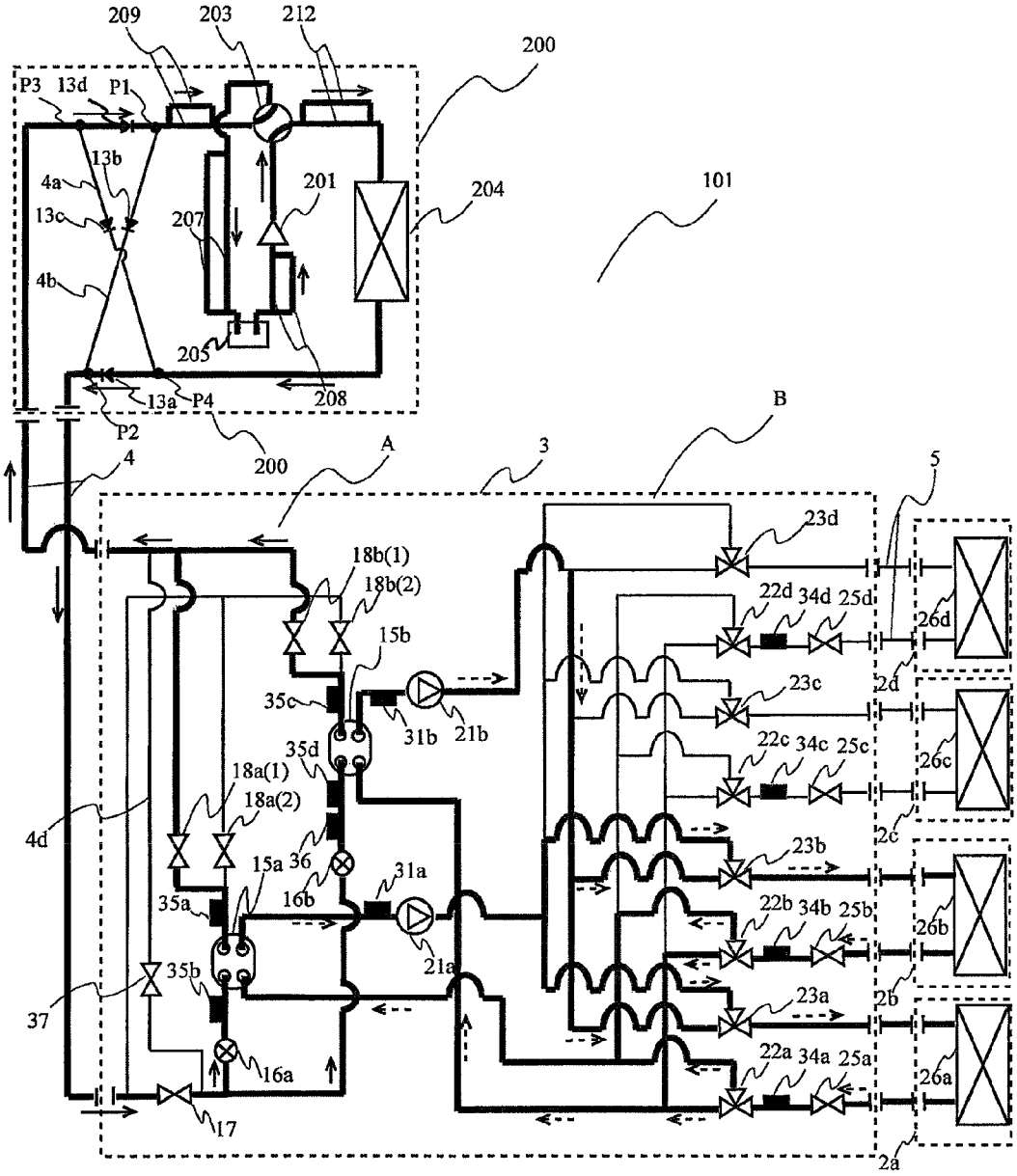
FIG. 6 illustrates a refrigerant flow in a cooling only operation mode of the air-conditioning apparatus illustrated in FIG. 5.

FIG. 6 is a refrigerant circuit diagram illustrating a refrigerant flow in the cooling only operation mode of the air-conditioning apparatus 101. The cooling only operation mode will be described with respect to a case in which a cooling load is generated only in the use side heat exchanger 26*a* and the use side heat exchanger 26*b* in FIG. 6. In FIG. 6, pipes indicated by thick lines correspond to pipes through which the refrigerants (the heat source side refrigerant and the heat medium) flow. Furthermore, referring to FIG. 6, solid-line arrows indicate the flow direction of the heat source side refrigerant and broken-line arrows indicate the flow direction of the heat medium.

In the cooling only operation mode illustrated in FIG. 6, in the outdoor unit 200, the first flow switching device 203 is allowed to perform switching such that the heat source side refrigerant discharged from the compressor 201 flows into the heat source side heat exchanger 204. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed such that the heat medium circulates between each of the heat exchanger 15*a* related to heat medium and the heat exchanger 15*b* related to heat medium, and each of the use side heat exchanger 26*a* and the use side heat exchanger 26*b*.

First, the flow of the heat source side refrigerant in the refrigerant circuit A will be described.

A low temperature, low pressure heat source side refrigerant is compressed by the compressor 201 and is discharged as a high temperature, high pressure gas refrigerant. The high temperature, high pressure gas refrigerant discharged from the compressor 201 flows through the first flow switching device 203 and the fourth refrigerant pipe 212 into the heat source side heat exchanger 204. Then, the refrigerant turns into a high pressure liquid refrigerant while transferring heat to outdoor air in the heat source side heat exchanger 204. The high pressure refrigerant which has flowed out of the heat source side heat exchanger 204 passes through the check valve 13*a*, flows out of the outdoor unit 200, passes through the refrigerant pipe 4, and flows into the heat medium relay unit 3. The high pressure refrigerant, which has flowed into the heat medium relay unit 3, passes through the opening and closing device 17 and is then divided into flows to the expansion device 16*a* and the expansion device 16*b*, in each of which the refrigerant is expanded into a two-phase gas liquid gas refrigerant at low temperature, low pressure. Additionally, the opening and closing device 17 is opened and the second opening and closing device 37 is closed.

This two-phase gas-liquid gas refrigerant flows into each of the heat exchanger 15*a* related to heat medium and the heat exchanger 15*b* related to heat medium functioning as an evaporator, removes heat from the heat medium circulating in the heat medium circuits B to cool the heat medium, and turns into a low temperature, low pressure gas refrigerant. The gas refrigerant, which has flowed out of each of the heat exchanger 15*a* related to heat medium and the heat exchanger 15*b* related to heat medium, flows out of the heat medium relay unit 3 through the the second flow switching device 18*a*(1) and the second flow switching device 18*b*(1), respectively, passes through the refrigerant pipe 4, and again flows into the outdoor unit 200. The refrigerant that has flowed into the outdoor unit 200 passes through the check valve 13*d*, and is suctioned into the compressor 201 again via the third refrigerant pipe 209, the first flow switching device 203, the first refrigerant pipe 207, the accumulator 205, and the second refrigerant pipe 208.

This refrigerant that has flowed into the outdoor unit 200 and has not yet flowed into the check valve 13*d* (see the point P3) is prevented from passing through the check valve 13*c*. This is because while this refrigerant that has flowed into the outdoor unit 200 and has not yet flowed into the check valve 13*d* (see the point P3) is in a low pressure gas state, the refrigerant flowing through the refrigerant pipe 4 on the point P4 side is in a high pressure gas state, so the check valve 13*c* becomes closed.

Here, the second flow switching devices 18*a*(1) and 18*b*(1) are opened and the second flow switching devices 18*a*(2) and 18*b*(2) are closed. Note that the refrigerant upstream in the bypass pipe 4*d* is in a high pressure gas state and the bypass pipe 4*d* is filled with the heat source side refrigerant in a high pressure gas state.

Further, the opening degree of the expansion device 16*a* is controlled such that the degree of superheat is constant, the super heat being obtained as the difference between a temperature detected by the third temperature sensor 35*a* and that detected by the third temperature sensor 35*b*. Similarly, the opening degree of the expansion device 16*b* is controlled such that the degree of superheat is constant, the superheat being obtained as the difference between a temperature detected by a third temperature sensor 35*c* and that detected by a third temperature sensor 35*d*.

Next, the flow of the heat medium in the heat medium circuits B will be described.

In the cooling only operation mode, both the heat exchanger 15*a* related to heat medium and the heat exchanger 15*b* related to heat medium transfer cooling energy of the heat source side refrigerant to the heat medium, and the pump 21*a* and the pump 21*b* allow the cooled heat medium to flow through the heat medium pipes 5. The heat medium, which has flowed out of each of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*. The heat medium removes heat from the indoor air in each of the use side heat exchanger 26*a* and the use side heat exchanger 26*b*, and thus cools the indoor space 7.

Then, the heat medium flows out of each of the use side heat exchanger 26*a* and the use side heat exchanger 26*b* and flows into the corresponding one of the heat medium flow control device 25*a* and the heat medium flow control device 25*b*. At this time, each of the heat medium flow control device 25*a* and the heat medium flow control device 25*b* controls a flow rate of the heat medium as necessary to cover an air conditioning load required in the indoor space 7 (see FIG. 4) such that the controlled flow rate of the heat medium flows into the corresponding one of the use side heat exchanger 26*a* and the use side heat exchanger 26*b*. The heat medium, which has flowed out of the heat medium flow control device 25*a* and the heat medium flow control device 25*b*, passes through the first heat medium flow switching device 22*a* and the first heat medium flow switching device 22*b*, respectively, flows into the heat exchanger 15*a* related to heat medium and the heat exchanger 15*b* related to heat medium, and then flows into the pump 21*a* and the pump 21*b*.

Note that in the pipe 5 of the use side heat exchanger 26, the heat medium is directed to flow from the second heat medium flow switching device 23 through the heat medium flow control device 25 to the first heat medium flow switching device 22. Furthermore, the difference between the temperature detected by the first temperature sensor 31*a* or that detected by the first temperature sensor 31*b* and the temperature detected by each of the second temperature sensors 34 is controlled such that the difference is held at a target value, so that the air conditioning load required in the indoor space 7 can be covered. As regards a temperature at the outlet of each heat exchanger 15 related to heat medium, either of the temperature detected by the first temperature sensor 31*a* or that detected by the first temperature sensor 31*b* may be used. Alternatively, the mean temperature of the two may be used. At this time, the opening degree of each of the first heat medium flow switching devices 22 and the second heat medium flow switching devices 23 are set to a medium degree such that passages to both of the heat exchanger 15*a* related to heat medium and the heat exchanger 15*b* related to heat medium are established.

Upon carrying out the cooling only operation mode, since it is unnecessary to supply the heat medium to each use side heat exchanger 26 having no air-conditioning load (including thermo-off), the passage is closed by the corresponding heat medium flow control device 25 such that the heat medium does not flow into the use side heat exchanger 26. Referring to FIG. 6, the heat medium flows into the use side heat exchanger 26*a* and the use side heat exchanger 26*b* because these use side heat exchangers each have an air-conditioning load. The use side heat exchanger 26*c* and the use side heat exchanger 26*d* have no air-conditioning load and the corresponding one of heat medium flow control devices 25*c* and 25*d* are fully closed. When an air-conditioning load is generated in the use side heat exchanger 26*c* or the use side heat exchanger 26*d*, the heat medium flow control device 25*c* or the heat medium flow control device 25*d* may be opened such that the heat medium is circulated.

[Heating Only Operation Mode]

Figure 7:
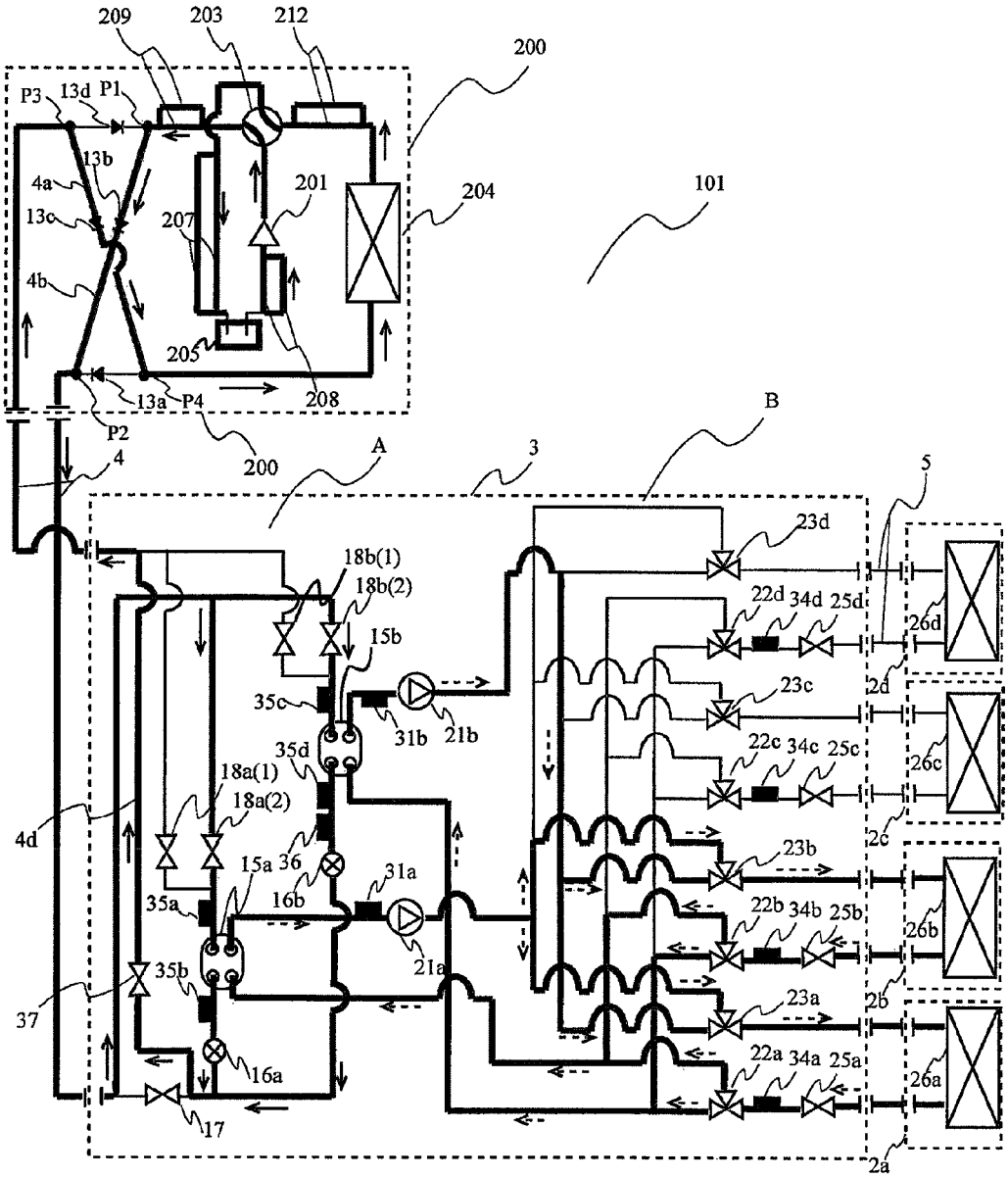
FIG. 7 illustrates a refrigerant flow in a heating only operation mode of the air-conditioning apparatus illustrated in FIG. 5.

FIG. 7 is a refrigerant circuit diagram illustrating a refrigerant flow in the heating only operation mode of the air-conditioning apparatus 101. The heating only operation mode will be described with respect to a case in which a heating load is generated only in the use side heat exchanger 26*a* and the use side heat exchanger 26*b* in FIG. 7. Referring to FIG. 7, pipes indicated by thick lines correspond to pipes through which the refrigerants (the heat source side refrigerant and the heat medium) flow. Furthermore, referring to FIG. 7, solid-line arrows indicate the flow direction of the heat source side refrigerant and broken-line arrows indicate the flow direction of the heat medium.

In the heating only operation mode illustrated in FIG. 7, the first flow switching device 203 is switched such that the heat source side refrigerant discharged from the compressor 201 flows into the heat medium relay unit 3 without passing through the heat source side heat exchanger 204 in the outdoor unit 200. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed such that the heat medium circulates between each of the heat exchanger 15*a* related to heat medium and the heat exchanger 15*b* related to heat medium, and each of the use side heat exchanger 26*a* and the use side heat exchanger 26*b*.

First, the flow of the heat source side refrigerant in the refrigerant circuit A will be described.

A low temperature, low pressure refrigerant is compressed by the compressor 201 and is discharged as a high temperature, high pressure gas refrigerant therefrom. The high temperature, high pressure gas refrigerant discharged from the compressor 201 passes through the first flow switching device 203, flows through the third refrigerant pipe 209, passes through the check valve 13*b*, and flows out of the outdoor unit 200. The high temperature, high pressure gas refrigerant that has flowed out of the outdoor unit 200 passes through the refrigerant pipe 4 and flows into the heat medium relay unit 3. The high temperature high pressure gas refrigerant that has flowed into the heat medium relay unit 3 is branched, passes through each of the second flow switching device 18*a*(2) and the second flow switching device 18*b*(2), and flows into the corresponding one of the heat exchanger 15*a* related to heat medium and the heat exchanger 15*b* related to heat medium.

The high temperature, high pressure gas refrigerant that has flowed into each of the heat exchanger 15*a* related to heat medium and the heat exchanger 15*b* related to heat medium turns into a high pressure liquid refrigerant while transferring heat to the heat medium circulating in the heat medium circuits B. The liquid refrigerant which has flowed out of the heat exchanger 15*a* related to heat medium and the heat exchanger 15*b* related to heat medium are expanded into a low temperature, low pressure two-phase refrigerant in the expansion device 16*a* and the expansion device 16*b*. This two-phase refrigerant passes through the second opening and closing device 37 and the bypass pipe 4*b* to flow out from the heat medium relay unit 3, and passes through the refrigerant pipe 4 to flow into the outdoor unit 200 again. Note that the opening and closing device 17 is closed.

The refrigerant that has flowed into the outdoor unit 200 passes through the check valve 13*c* and flows into the heat source side heat exchanger 204 functioning as an evaporator. The refrigerant, which has flowed into the heat source side heat exchanger 204, removes heat from the outdoor air in the heat source side heat exchanger 204, such that it turns into a low temperature, low pressure gas refrigerant. The low temperature, low pressure gas refrigerant that has flowed out from the heat source side heat exchanger 204 flows into the compressor 201 via the fourth refrigerant pipe 212, the first flow switching device 203, the first refrigerant pipe 207, the accumulator 205, and the second refrigerant pipe 208.

The refrigerant that has flowed into the outdoor unit 200 and has not yet flowed into the check valve 13*c* (see the point P3) is prevented from passing through the check valve 13*d*. This is because while this refrigerant that has flowed into the outdoor unit 200 and has not yet flowed into the check valve 13*c* (see the point P3) is in a low pressure gas state, the refrigerant flowing through the refrigerant pipe 4 on the point P1 side is in a high pressure gas state, so the check valve 13*d* becomes closed.

For the same reason, while the refrigerant flowing at the point P4 is in a low pressure gas state, the refrigerant flowing at the point P2 is in a high pressure gas state, so the check valve 13*a* becomes closed, thereby preventing the refrigerant from passing through the check valve 13*a*.

Here, the second flow switching devices 18*a*(2) and 18*b*(2) are opened and the second flow switching devices 18*a*(1) and 18*b*(1) are closed.

Further, the opening degree of the expansion device 16*a* is controlled such that subcooling (degree of subcooling) obtained as the difference between a saturation temperature converted from a pressure detected by the pressure sensor 36 and a temperature detected by the third temperature sensor 35*b* is constant. Similarly, the opening degree of the expansion device 16*b* is controlled such that subcooling obtained as the difference between the saturation temperature converted from the pressure detected by the pressure sensor 36 and a temperature detected by the third temperature sensor 35*d* is consistent. Further, when a temperature at the middle position of the heat exchangers 15 related to heat medium can be measured, the temperature at the middle position may be used instead of the pressure sensor 36. Accordingly, the system can be constructed inexpensively.

Next, the flow of the heat medium in the heat medium circuits B will be described.

In the heating only operation mode, both of the heat exchanger 15*a* related to heat medium and the heat exchanger 15*b* related to heat medium transfer heating energy of the heat source side refrigerant to the heat medium and the pump 21*a* and the pump 21*b* allow the heated heat medium to flow through the heat medium pipes 5. The heat medium, which has flowed out of each of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*. The heat medium transfers heat to the indoor air in each of the use side heat exchanger 26*a* and the use side heat exchanger 26*b*, and thus heats the indoor space 7.

Then, the heat medium flows out of each of the use side heat exchanger 26*a* and the use side heat exchanger 26*b* and flows into the corresponding one of the heat medium flow control device 25*a* and the heat medium flow control device 25*b*. At this time, each of the heat medium flow control device 25*a* and the heat medium flow control device 25*b* controls a flow rate of the heat medium as necessary to cover an air conditioning load required in the indoor space such that the controlled flow rate of the heat medium flows into the corresponding one of the use side heat exchanger 26*a* and the use side heat exchanger 26*b*. The heat medium, which has flowed out of the heat medium flow control device 25*a* and the heat medium flow control device 25*b*, passes through the first heat medium flow switching device 22*a* and the first heat medium flow switching device 22*b*, respectively, flows into the heat exchanger 15*a* related to heat medium and the heat exchanger 15*b* related to heat medium, and is then again suctioned into the pump 21*a* and the pump 21*b*.

Note that in the pipe 5 of the use side heat exchanger 26, the heat medium is directed to flow from the second heat medium flow switching device 23 through the heat medium flow control device 25 to the first heat medium flow switching device 22. The air conditioning load required in the indoor space 7 can be covered by controlling the difference between a temperature detected by the first temperature sensor 31*a* or a temperature detected by the first temperature sensor 31*b* and a temperature detected by the second temperature sensor 34 so that difference is held at a target value. As regards a temperature at the outlet of each heat exchanger 15 related to heat medium, either of the temperature detected by the first temperature sensor 31*a* or that detected by the first temperature sensor 31*b* may be used. Alternatively, the mean temperature of the two may be used.

At this time, the opening degree of each of the first heat medium flow switching devices 22 and the second heat medium flow switching devices 23 are set to a medium degree such that passages to both of the heat exchanger 15*a* related to heat medium and the heat exchanger 15*b* related to heat medium are established. Although the use side heat exchanger 26*a* should essentially be controlled on the basis of the difference between a temperature at the inlet and that at the outlet thereof, since a temperature of the heat medium on the inlet side of the use side heat exchanger 26 is substantially the same as the temperature detected by the first temperature sensor 31*b*, the use of the first temperature sensor 31*b* can reduce the number of temperature sensors, so that the system can be established inexpensively.

Upon carrying out the heating only operation mode, since it is unnecessary to supply the heat medium to each use side heat exchanger 26 having no air-conditioning load (including thermo-off state), the passage is closed by the corresponding heat medium flow control device 25 such that the heat medium does not flow into the use side heat exchanger 26. Referring to FIG. 7, the heat medium flows into the use side heat exchanger 26*a* and the use side heat exchanger 26*b* because these use side heat exchangers each have an air-conditioning load. The use side heat exchanger 26*c* and the use side heat exchanger 26*d* have no air-conditioning load and the corresponding one of heat medium flow control devices 25*c* and 25*d* are fully closed. When an air-conditioning load is generated in the use side heat exchanger 26*c* or the use side heat exchanger 26*d*, the heat medium flow control device 25*c* or the heat medium flow control device 25*d* may be opened such that the heat medium is circulated.

[Cooling Main Operation Mode]

Figure 8:
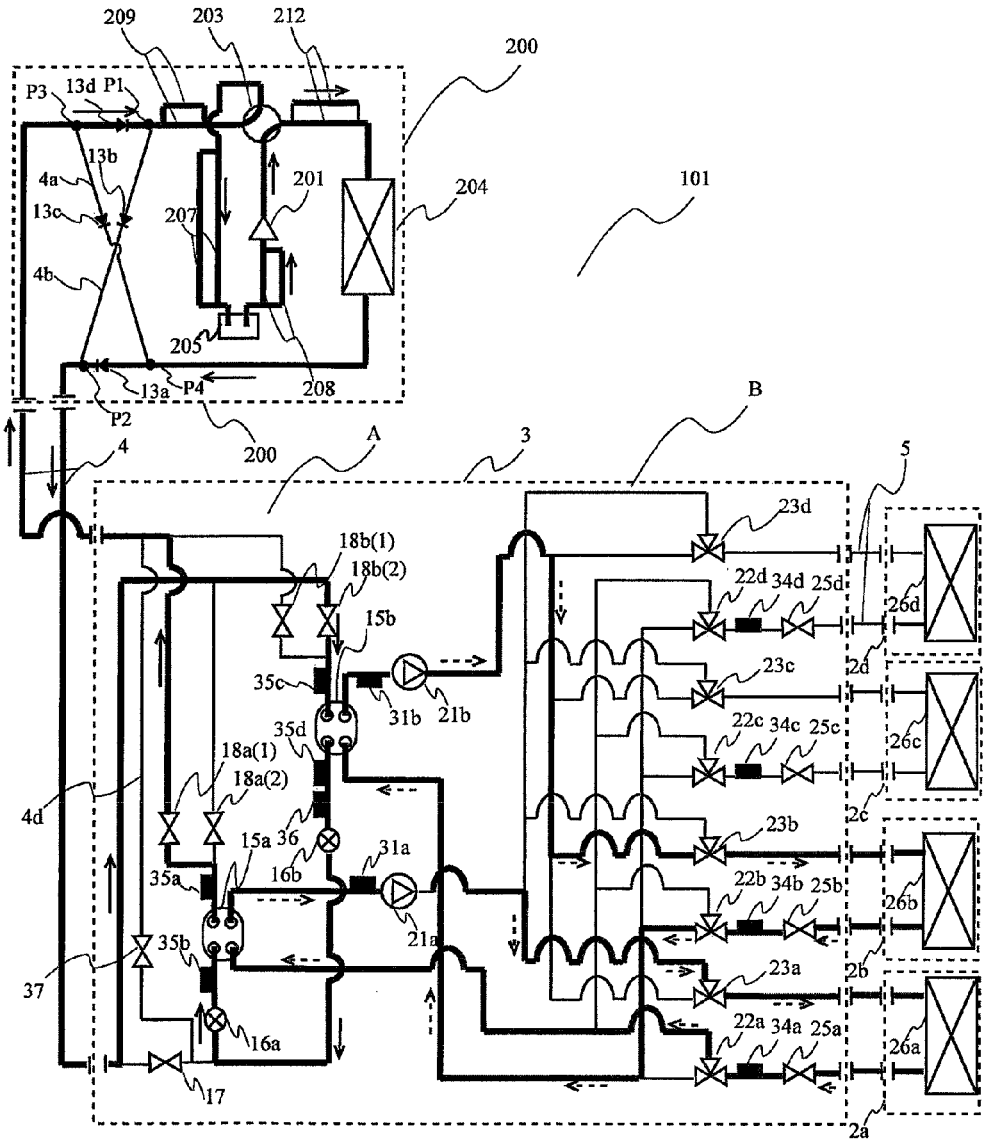
FIG. 8 illustrates a refrigerant flow in a cooling main operation mode of the air-conditioning apparatus illustrated in FIG. 5.

FIG. 8 is a refrigerant circuit diagram illustrating a flow of the refrigerant in the cooling main operation mode of the air-conditioning apparatus 101. The cooling main operation mode will be described with respect to a case in which a cooling load is generated in the use side heat exchanger 26*a* and a heating load is generated in the use side heat exchanger 26*b* in FIG. 8. Further, referring to FIG. 8, pipes indicated by thick lines correspond to the pipes through which the refrigerants (the heat source side refrigerant and the heat medium) circulate. Furthermore, referring to FIG. 8, solid-line arrows indicate the flow direction of the heat source side refrigerant and broken-line arrows indicate the flow direction of the heat medium.

In the cooling main operation mode illustrated in FIG. 8, in the outdoor unit 200, the first flow switching device 203 is allowed to perform switching such that the heat source side refrigerant discharged from the compressor 201 flows into the heat source side heat exchanger 204. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed such that the heat medium circulates between the heat exchanger 15*a* related to heat medium and the use side heat exchanger 26*a*, and between the heat exchanger 15*b* related to heat medium and the use side heat exchanger 26*b*.

First, the flow of the heat source side refrigerant in the refrigerant circuit A will be described.

A low temperature, low pressure refrigerant is compressed by the compressor 201 and is discharged as a high temperature, high pressure gas refrigerant therefrom. The high temperature, high pressure gas refrigerant discharged from the compressor 201 flows through the first flow switching device 203 and the fourth refrigerant pipe 212 into the heat source side heat exchanger 204 functioning as a radiator. Then, the refrigerant turns into a liquid refrigerant while transferring heat to outdoor air in the heat source side heat exchanger 204. The refrigerant, which has flowed out of the heat source side heat exchanger 204, passes through the check valve 13*a*, flows out of the outdoor unit 200, passes through the refrigerant pipe 4, and flows into the heat medium relay unit 3. The refrigerant, which has flowed into the heat medium relay unit 3, passes through the second flow switching device 18*b*(2) and flows into the heat exchanger 15*b* related to heat medium, functioning as a radiator.

The refrigerant that has flowed into the heat exchanger 15*b* related to heat medium turns into a refrigerant that has further lowered its temperature while transferring heat to the heat medium circulating in the heat medium circuit B. The refrigerant, which has flowed from the heat exchanger 15*b* related to heat medium, is expanded into a low pressure two-phase refrigerant by the expansion device 16*b*. This low pressure two-phase refrigerant flows through the expansion device 16*a* and into the heat exchanger 15*a* related to heat medium functioning as an evaporator. The low pressure two-phase refrigerant, which has flowed into the heat exchanger 15*a* related to heat medium, removes heat from the heat medium circulating in the heat medium circuits B to cool the heat medium, and thus turns into a low pressure gas refrigerant. The gas refrigerant flows out of the heat exchanger 15*a* related to heat medium, passes through the second flow switching device 18*a*(1), flows out of the heat medium relay unit 3, and flows into the outdoor unit 200 again through the refrigerant pipe 4. The refrigerant that has flowed into the outdoor unit 200 passes through the check valve 13*d*, and is suctioned into the compressor 201 again via the third refrigerant pipe 209, the first flow switching device 203, the first refrigerant pipe 207, the accumulator 205, and the second refrigerant pipe 208.

This refrigerant that has flowed into the outdoor unit 200 and has not yet flowed into the check valve 13*d* (see the point P3) is prevented from passing through the check valve 13*c*. This is because while this refrigerant that has flowed into the outdoor unit 200 and has not yet flowed into the check valve 13*d* (see the point P3) is in a low pressure gas state, the refrigerant flowing through the refrigerant pipe 4 on the point P4 side is in a high pressure gas state, so the check valve 13*c* becomes closed.

Here, the second flow switching device 18*a*(1) is opened, the second flow switching device 18*a*(2) is closed, the second flow switching device 18*b*(1) is closed, and the second flow switching device 18*b*(2) is opened.

The opening and closing device 17 and the second opening and closing device 37 are both in a closed state.

Further, the opening degree of the expansion device 16*b* is controlled such that the degree of superheat is constant, the super heat being obtained as the difference between a temperature detected by the third temperature sensor 35*a* and that detected by the third temperature sensor 35*b*. Furthermore, the expansion device 16*a* is fully opened and the opening and closing device 17 is closed. Note that the opening degree of the expansion device 16*b* may be controlled such that subcooling obtained as the difference between a value indicating a saturation temperature converted from a pressure detected by the pressure sensor 36 and a temperature detected by the third temperature sensor 35*d* is constant. Alternatively, the expansion device 16*b* may be fully opened and the expansion device 16*a* may control the degree of superheat or the subcooling.

Next, the flow of the heat medium in the heat medium circuits B will be described.

In the cooling main operation mode, the heat exchanger 15*b* related to heat medium transfers heating energy of the heat source side refrigerant to the heat medium, and the pump 21*b* allows the heated heat medium to flow through the heat medium pipes 5. Furthermore, in the cooling main operation mode, the heat exchanger 15*a* related to heat medium transfers cooling energy of the heat source side refrigerant to the heat medium, and the pump 21*a* allows the cooled heat medium to flow through the heat medium pipes 5. The heat medium, which has flowed out of the pump 21*a* and the pump 21*b* while being pressurized, flows through the second heat medium flow switching device 23*a* and the second heat medium flow switching device 23*b*, respectively, into the corresponding one of the use side heat exchanger 26*a* and the use side heat exchanger 26*b*.

In the use side heat exchanger 26*b*, the heat medium transfers heat to the indoor air, thus heats the indoor space 7. In addition, in the use side heat exchanger 26*a*, the heat medium removes heat from the indoor air, thus cools the indoor space 7. At this time, each of the heat medium flow control device 25*a* and the heat medium flow control device 25*b* controls a flow rate of the heat medium as necessary to cover an air conditioning load required in the indoor space such that the controlled flow rate of the heat medium flows into the corresponding one of the use side heat exchanger 26*a* and the use side heat exchanger 26*b*. The heat medium, which has passed through the use side heat exchanger 26*b* with a slight decrease of temperature, passes through the heat medium flow control device 25*b* and the first heat medium flow switching device 22*b*, flows into the heat exchanger 15*b* related to heat medium, and is then again suctioned into the pump 21*b*. The heat medium, which has passed through the use side heat exchanger 26*a* with a slight increase of temperature, passes through the heat medium flow control device 25*a* and the first heat medium flow switching device 22*a*, flows into the heat exchanger 15*a* related to heat medium, and is then again suctioned into the pump 21*a*.

During this time, the first heat medium flow switching devices 22 and the second heat medium flow switching devices 23 allow the warm heat medium and the cold heat medium to be introduced into the use side heat exchanger 26 having a heating load and the use side heat exchanger 26 having a cooling load, respectively, without mixing with each other. Note that in the heat medium pipes 5 of each use side heat exchanger 26 for heating and that for cooling, the heat medium is directed to flow from the second heat medium flow switching device 23 through the heat medium flow control device 25 to the first heat medium flow switching device 22. Furthermore, the difference between a temperature detected by the first temperature sensor 31*b* and that detected by each of the second temperature sensors 34 is controlled such that the difference is held at a target value, so that the air conditioning load required in the indoor space 7 for heating can be covered. The difference between a temperature detected by each of the second temperature sensors 34 and that detected by the first temperature sensor 31*a* is controlled such that the difference is held at a target value, so that the air conditioning load required in the indoor space 7 for cooling can be covered.

Upon carrying out the cooling main operation mode, since it is unnecessary to supply the heat medium to each use side heat exchanger 26 having no air-conditioning load (including thermo-off state), the passage is closed by the corresponding heat medium flow control device 25 such that the heat medium does not flow into the use side heat exchanger 26. Referring to FIG. 8, the heat medium flows into the use side heat exchanger 26*a* and the use side heat exchanger 26*b* because these use side heat exchangers each have an air-conditioning load. The use side heat exchanger 26*c* and the use side heat exchanger 26*d* have no air-conditioning load and the corresponding heat medium flow control devices 25*c* and 25*d* are fully closed. When an air-conditioning load is generated in the use side heat exchanger 26*c* or the use side heat exchanger 26*d*, the heat medium flow control device 25*c* or the heat medium flow control device 25*d* may be opened such that the heat medium is circulated.

[Heating Main Operation Mode]

Figure 9:
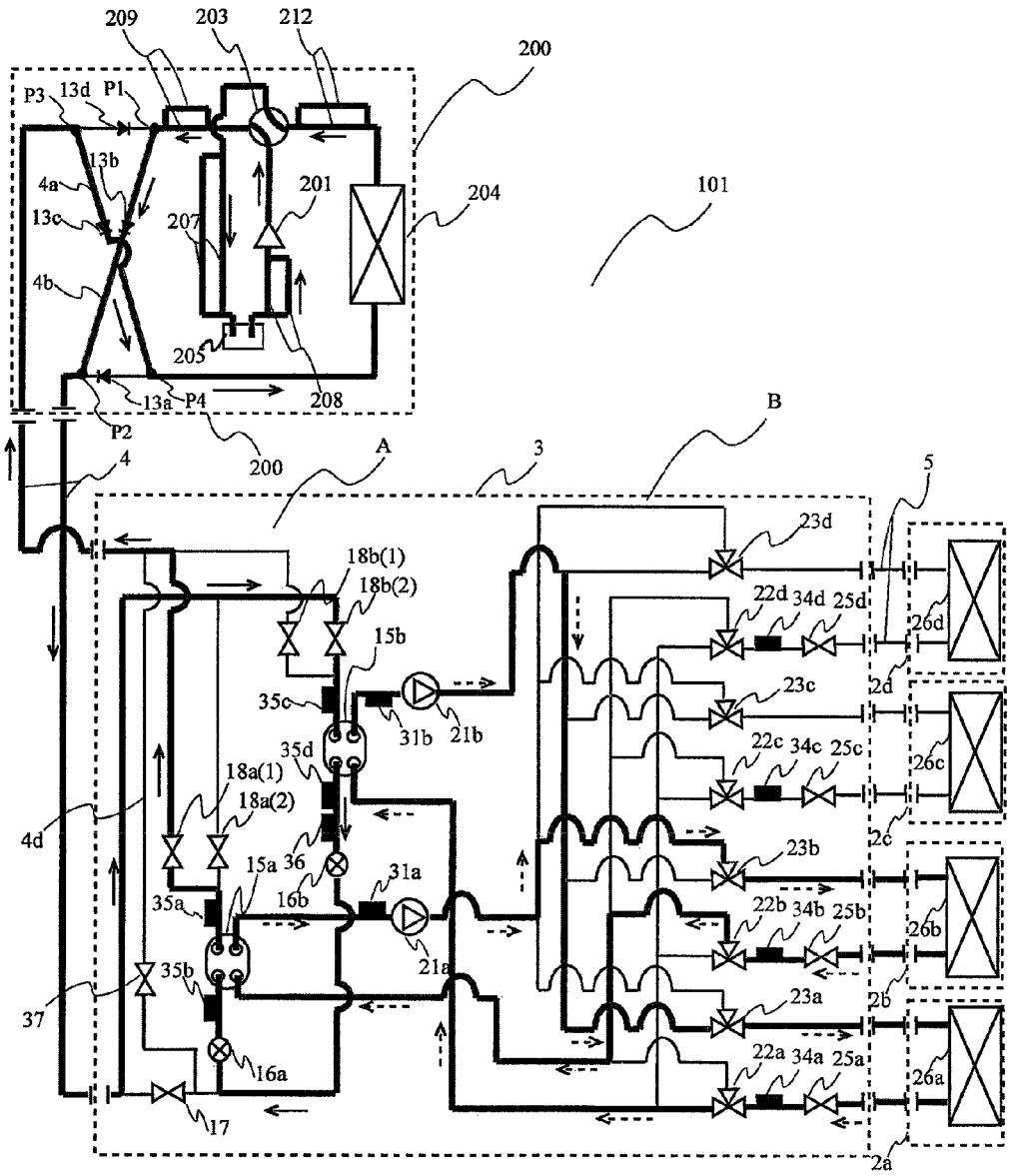
FIG. 9 illustrates a refrigerant flow in a heating main operation mode of the air-conditioning apparatus illustrated in FIG. 5.

FIG. 9 is a refrigerant circuit diagram illustrating a flow of the refrigerant in the heating main operation mode of the air-conditioning apparatus 101. The heating main operation mode will be described with respect to a case in which a heating load is generated in the use side heat exchanger 26*a* and a cooling load is generated in the use side heat exchanger 26*b* in FIG. 9. Further, referring to FIG. 9, pipes indicated by thick lines correspond to the pipes through which the refrigerants (the heat source side refrigerant and the heat medium) circulate. Furthermore, referring to FIG. 9, solid-line arrows indicate the flow direction of the heat source side refrigerant and broken-line arrows indicate the flow direction of the heat medium.

In the heating main operation mode illustrated in FIG. 9, in the outdoor unit 200, the first flow switching device 203 is allowed to perform switching such that the heat source side refrigerant discharged from the compressor 201 flows into the heat medium relay unit 3 without passing through the heat source side heat exchanger 204. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed such that the heat medium circulates between the heat exchanger 15*a* related to heat medium and the use side heat exchanger 26*b* and also circulates between the heat exchanger 15*b* related to heat medium and the use side heat exchanger 26*a*.

First, the flow of the heat source side refrigerant in the refrigerant circuit A will be described.

A low temperature, low pressure refrigerant is compressed by the compressor 201 and is discharged as a high temperature, high pressure gas refrigerant therefrom. The high temperature, high pressure gas refrigerant discharged from the compressor 201 passes through the first flow switching device 203, flows through the third refrigerant pipe 209, passes through the check valve 13*b*, and flows out of the outdoor unit 200. The high temperature, high pressure gas refrigerant that has flowed out of the outdoor unit 200 passes through the refrigerant pipe 4 and flows into the heat medium relay unit 3. The high temperature, high pressure gas refrigerant which has flowed into the heat medium relay unit 3 passes through the second flow switching device 18*b*(2) and flows into the heat exchanger 15*b* related to heat medium functioning as a radiator.

The gas refrigerant that has flowed into the heat exchanger 15*b* related to heat medium turns into a liquid refrigerant while transferring heat to the heat medium circulating in the heat medium circuits B. The refrigerant which has flowed from the heat exchanger 15*b* related to heat medium is expanded into a low pressure two-phase refrigerant by the expansion device 16*b*. This low pressure two-phase refrigerant flows through the expansion device 16*a* and into the heat exchanger 15*a* related to heat medium functioning as an evaporator. The low pressure two-phase refrigerant, which has flowed into the heat exchanger 15*a* related to heat medium, removes heat from the heat medium circulating in the heat medium circuits B such that the refrigerant is evaporated to cool the heat medium. This low pressure two-phase refrigerant flows out of the heat exchanger 15*a* related to heat medium, passes through the second flow switching device 18*a*(1), flows out of the heat medium relay unit 3, passes through the refrigerant pipe 4, and again flows into the outdoor unit 200.

The refrigerant that has flowed into the outdoor unit 200 passes through the check valve 13*c* and flows into the heat source side heat exchanger 204 functioning as an evaporator. The refrigerant, which has flowed into the heat source side heat exchanger 204, removes heat from the outdoor air in the heat source side heat exchanger 204, such that it turns into a low temperature, low pressure gas refrigerant. The low temperature, low pressure gas refrigerant that has flowed out from the heat source side heat exchanger 204 is suctioned again into the compressor 201 via the fourth refrigerant pipe 212, the first flow switching device 203, the first refrigerant pipe 207, the accumulator 205, and the second refrigerant pipe 208.

This refrigerant that has flowed into the outdoor unit 200 and has not yet flowed into the check valve 13*c* (see the point P3) is prevented from passing through the check valve 13*d*. This is because while this refrigerant that has flowed into the outdoor unit 200 and has not yet flowed into the check valve 13*c* (see the point P3) is in a low pressure gas state, the refrigerant flowing through the refrigerant pipe 4 on the point P1 side is in a high pressure gas state, so the check valve 13*d* becomes closed.

For the same reason, while the refrigerant flowing at the point P4 is in a low pressure gas state, the refrigerant flowing at the point P2 is in a high pressure gas state, so the check valve 13*a* becomes closed, thereby preventing the refrigerant from passing through the check valve 13*a*.

Here, the second flow switching device 18*a*(2) is closed, the second flow switching device 18*a*(1) is opened, the second flow switching device 18*b*(2) is opened, and the second flow switching device 18*b*(2) is closed.

At this time, the opening degree of the expansion device 16*b* is controlled such that subcooling is constant, the subcooling being obtained as the difference between a value indicating a saturation temperature converted from a pressure detected by the pressure sensor 36 and a temperature detected by the third temperature sensor 35*b*. Furthermore, the expansion device 16*a* is fully opened and the opening and closing device 17 is closed. Alternatively, the expansion device 16*b* may be fully opened and the expansion device 16*a* may control the subcooling.

Next, the flow of the heat medium in the heat medium circuits B will be described.

In the heating main operation mode, the heat exchanger 15*b* related to heat medium transfers heating energy of the heat source side refrigerant to the heat medium, and the pump 21*b* allows the heated heat medium to flow through the heat medium pipes 5. Furthermore, in the heating main operation mode, the heat exchanger 15*a* related to heat medium transfers cooling energy of the heat source side refrigerant to the heat medium, and the pump 21*a* allows the cooled heat medium to flow through the heat medium pipes 5. The heat medium, which has flowed out of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*.

In the use side heat exchanger 26*b*, the heat medium removes heat from the indoor air, thus cools the indoor space 7. In addition, in the use side heat exchanger 26*a*, the heat medium transfers heat to the indoor air, thus heats the indoor space 7. At this time, each of the heat medium flow control device 25*a* and the heat medium flow control device 25*b* controls a flow rate of the heat medium as necessary to cover an air conditioning load required in the indoor space such that the controlled flow rate of the heat medium flows into the corresponding one of the use side heat exchanger 26*a* and the use side heat exchanger 26*b*. The heat medium, which has passed through the use side heat exchanger 26*b* with a slight increase of temperature, passes through the heat medium flow control device 25*b* and the first heat medium flow switching device 22*b*, flows into the heat exchanger 15*a* related to heat medium, and is then again suctioned into the pump 21*a*. The heat medium, which has passed through the use side heat exchanger 26*a* with a slight decrease of temperature, passes through the heat medium flow control device 25*a* and the first heat medium flow switching device 22*a*, flows into the heat exchanger 15*b* related to heat medium, and is then suctioned into the pump 21*b* again.

During this time, the first heat medium flow switching devices 22 and the second heat medium flow switching devices 23 allow the warm heat medium and the cold heat medium to be introduced into the use side heat exchanger 26 having a heating load and the use side heat exchanger 26 having a cooling load, respectively, without mixing with each other. Note that in the heat medium pipes 5 of each use side heat exchanger 26 for heating and that for cooling, the heat medium is directed to flow from the second heat medium flow switching device 23 through the heat medium flow control device 25 to the first heat medium flow switching device 22. Furthermore, the difference between a temperature detected by the first temperature sensor 31*b* and that detected by each of the second temperature sensors 34 is controlled such that the difference is held at a target value, so that the air conditioning load required in the indoor space 7 for heating can be covered. The difference between a temperature detected by each of the second temperature sensors 34 and that detected by the first temperature sensor 31*a* is controlled such that the difference is held at a target value, so that the air conditioning load required in the indoor space 7 for cooling can be covered.

Upon carrying out the heating main operation mode, since it is unnecessary to supply the heat medium to each use side heat exchanger 26 having no air-conditioning load (including thermo-off), the passage is closed by the corresponding heat medium flow control device 25 such that the heat medium does not flow into the use side heat exchanger 26. Referring to FIG. 7, the heat medium flows into the use side heat exchanger 26*a* and the use side heat exchanger 26*b* because these use side heat exchangers each have an air-conditioning load. The use side heat exchanger 26*c* and the use side heat exchanger 26*d* have no air-conditioning load and the corresponding heat medium flow control devices 25*c* and 25*d* are fully closed. When an air-conditioning load is generated in the use side heat exchanger 26*c* or the use side heat exchanger 26*d*, the heat medium flow control device 25*c* or the heat medium flow control device 25*d* may be opened such that the heat medium is circulated.

[Advantageous Effects of Air-Conditioning Apparatus 101]

It is needless to mention that while the air-conditioning apparatus 101 according to Embodiment 2 has two refrigeration cycles, the effects equivalent to the effects provided by the air-conditioning apparatus 100 according to Embodiment 1 can be obtained. In this way, the air-conditioning apparatus 101 is provided with the first to third refrigerant pipes 207 to 209 each of which are partially configured by two pipes connected in parallel (or a plurality of pipes in parallel). Therefore, even when a low pressure refrigerant such as HFO1234yf is adopted, pressure loss of the refrigerant can be reduced while suppressing the machining cost and manufacturing cost of the air-conditioning apparatus 101. Moreover, because the diameter of the first to third refrigerant pipes 207 to 209 is not made large, the bending radius of the first to third refrigerant pipes 207 to 209 can be made small, thereby making the air-conditioning apparatus 101 compact.

[Refrigerant Pipes 4]

As described above, the air-conditioning apparatus 101 is capable of performing the cooling only operation mode, the cooling main operation mode, the heating only operation mode, and the heating main operation mode. In each operation mode, the heat source side refrigerant flows through the refrigerant pipes 4 connecting the outdoor unit 200 and the heat medium relay unit 3.

[Heat Medium Pipes 5]

In some operation modes carried out by the air-conditioning apparatus 101, the heat medium, such as water or antifreeze, flows through the heat medium pipes 5 connecting the heat medium relay unit 3 and the indoor units 2.

[Heat Source Side Refrigerant]

For the air-conditioning apparatus 101, a refrigerant whose global warming potential is small and which has flammability is used. For example, a tetrafluoropropene-based refrigerant such as HFO1234yf or HFO1234ze is used. Furthermore, it can be a mixed refrigerant containing the above.

FIG. 13 illustrates the relationship between the ratio (weight percentage) of HFO1234yf contained in the refrigerant, and the pressure loss. FIG. 13 illustrates computation results in a case where about 10 HP and ϕ25.4 are used as the capacity of the air-conditioning apparatus (the capacity or output of the compressor) and the pipe diameter, respectively. The plotted points indicated by circle marks in the drawing represent computation results for a pipe (a single pipe) of ϕ25.4. The plotted points indicated by rectangular marks represent computation results for a pipe formed by connecting two pipes of ϕ25.4 in parallel. Further, broken lines represent the pressure loss of a conventional refrigerant (R410).

FIG. 13 shows that when the pipe is formed by two pipes of ϕ25.4 connected in parallel, the ratio of HFO1234yf at which the pressure loss becomes the same as that of the conventional refrigerant is approximately 75%, by the broken lines and the plotted points indicated by rectangular marks. When the ratio of HFO1234yf contained in the refrigerant becomes equal to or higher than approximately 75%, the pressure loss becomes greater than the pressure loss of the conventional refrigerant. Accordingly, in a case where the ratio of HFO1234yf contained in the refrigerant is equal to or higher than approximately 75%, the pressure loss can be made equivalent to that of the conventional refrigerant by adopting a pipe that is formed by connecting two pipes with a pipe diameter larger than ϕ25.4 in parallel.

For HFO1234ze with substantially the same physical properties as HFO1234yf as well, the pressure loss can be made equivalent to that of the conventional refrigerant by adopting a pipe that is formed by connecting two pipes with a pipe diameter larger than ϕ25.4 in parallel.

[Heat Medium]

As the heat medium, for example, brine (antifreeze), water, a mixed solution of brine and water, or a mixed solution of water and an additive with high anticorrosive effect can be used. In the air-conditioning apparatus 101, therefore, even when the heat medium leaks through the indoor unit 2 into the indoor space 7, the safety of the heat medium used is high. Accordingly, it contributes to safety improvement.

Further, in the cooling main operation mode and the heating main operation mode, when the state (heating or cooling) of the heat exchanger 15*b* related to heat medium and the heat exchanger 15*a* related to heat medium changes, the water that had been hot is cooled turning into cold water and the water that had been cold is heated turning into hot water, and thus waste of energy occurs. Hence, the air-conditioning apparatus 101 is configured such that during both cooling main operation mode and heating main operation mode, the heat exchanger 15*b* related to heat medium is always on the heating side and the heat exchanger 15*a* related to heat medium is always on the cooling side.

In addition, in the case where the heating load and the cooling load are simultaneously generated in the use side heat exchangers 26, the first heat medium flow switching device 22 and the second heat medium flow switching device 23 corresponding to the use side heat exchanger 26 which performs the heating operation are switched to the passage connected to the heat exchanger 15*b* related to heat medium for heating, and the first heat medium flow switching device 22 and the second heat medium flow switching device 23 corresponding to the use side heat exchanger 26 which performs the cooling operation are switched to the passage connected to the heat exchanger 15*a* related to heat medium for cooling, so that the heating operation or cooling operation can be freely performed in the indoor units 2*a* to 2*b*.

Furthermore, each of the first heat medium flow switching devices 22 and the second heat medium flow switching devices 23 may be any of the sort as long as they can switch passages, for example, a three-way valve capable of switching between three passages or a combination of two on-off valves and the like switching between two passages. Alternatively, as each of the first heat medium flow switching devices 22 and the second heat medium flow switching devices 23, for example, a stepping-motor-driven mixing valve, capable of changing a flow rate in a three-way passage may be used, or, two electronic expansion valves, capable of changing a flow rate in a two-way passage may be used in combination. In this case, water hammer caused when a passage is suddenly opened or closed can be prevented. Furthermore, while an exemplary description in which the heat medium flow control devices 25 each include a two-way valve has been given, each of the heat medium flow control devices 25 may include a control valve having three-way passage and the valve may be disposed with a bypass pipe that bypasses the use side heat exchanger 26.

Furthermore, each of the heat medium flow control devices 25 may be a two-way valve or a three-way valve whose one end is closed as long as it is capable of controlling a flow rate in a passage in a stepping-motor-driven manner. Alternatively, each of the heat medium flow control devices 25 may be an on-off valve and the like, opening or closing a two-way passage such that the average flow rate is controlled while ON and OFF operations are repeated.

Furthermore, while each second flow switching device 18 has been described as if it is a four-way valve, the device is not limited to this type. The device may be configured such that the refrigerant flows in the same manner using a plurality of three-way flow switching valves. Additionally, a four-way valve may be used to constitute each second flow switching device 18.

While the air-conditioning apparatus 101 has been described with respect to the case in which the apparatus can perform the cooling and heating mixed operation, the apparatus is not limited to the case. Even with an apparatus that is configured with a plurality of use side heat exchangers 26 and heat medium flow control devices 25 which are connected in parallel to a single heat exchanger 15 related to heat medium and a single expansion device 16, and is capable of carrying out only a cooling operation or a heating operation, the same advantages as the air-conditioning apparatus 101 can be obtained.

In addition, it is needless to say that the same holds true for the case in which only a single use side heat exchanger 26 and a single heat medium flow control device 25 are connected. Moreover, no problem will arise even when the heat exchanger 15 related to heat medium and the expansion device 16 acting in the same manner are arranged in plural numbers. Further, while the case where the heat medium flow control device 25 is provided within the heat medium relay unit 3 has been described, there is no particular limitation in this regard. The heat medium flow control device 25 may be provided within the indoor unit 2.

Typically, each of the heat source side heat exchanger 204 and the use side heat exchangers 26 is provided with an air-sending device and in many cases, air sending facilitates condensation or evaporation. However, the structure is not limited to this case. For example, a panel heater and the like, taking advantage of radiation can be used as the use side heat exchanger 26 and a water-cooled heat exchanger which transfers heat using water or antifreeze can be used as the heat source side heat exchanger 204. In other words, as long as the heat exchanger is configured to be capable of transferring heat or removing heat, any type of heat exchanger can be used as each of the heat source side heat exchanger 204 and the use side heat exchanger 26.

While the case where there are provided two heat exchangers 15*a* and 15*b* related to heat medium in the air-conditioning apparatus 101 has been described, the configuration is not particularly limited as long as the heat medium can be cooled or heated. Furthermore, each of the number of pumps 21*a* and that of pumps 21*b* is not limited to one. A plurality of pumps having a small capacity may be connected in parallel.

The air-conditioning apparatus 101 has been described with respect to the case in which a single first heat medium flow switching device 22, a single second heat medium flow switching device 23, and a single heat medium flow control device 25 are connected to each use side heat exchanger 26. The arrangement is not limited to this case. A plurality of devices 22, a plurality of devices 23, and a plurality of devices 25 may be connected to each use side heat exchanger 26. In this case, the first heat medium flow switching devices 22, the second heat medium flow switching devices 23, and the heat medium flow control devices 25 connected to the same use side heat exchanger 26 may be operated in the same manner.

REFERENCE SIGNS LIST

2 (2*a*, 2*b*, 2*c*, 2*d*) indoor unit; 3 heat medium relay unit; 4 refrigerant pipe; 4*a* first connection pipe; 4*b* second connection pipe; 4*d* bypass pipe; 5 heat medium pipe; 6 outdoor space; 7 indoor space; 8 space; 9 structure; 13 (13*a*, 13*b*, 13*c*, 13*d*) check valve; 15 (15*a*, 15*b*) heat exchanger related to heat medium; 16 (16*a*, 16*b*) expansion device; 17 opening and closing device; 18 (18*a*(1), 18*a*(2), 18*b*(1), 18*b*(2)) second flow switching device; 21 (21*a*, 21*b*) pump; 22 (22*a*, 22*b*, 22*c*, 22*d*) first heat medium flow switching device; 23 (23*a*, 23*b*, 23*c*, 23*d*) second heat medium flow switching device; 25 (25*a*, 25*b*, 25*c*, 25*d*) heat medium flow control device; 26 (26*a*, 26*b*, 26*c*, 26*d*) use side heat exchanger; 31 (31*a*, 31*b*) first temperature sensor; 34 (34*a*, 34*b*, 34*c*, 34*d*) second temperature sensor; 35 (35*a*, 35*b*, 35*c*, 35*d*) third temperature sensor; 36 pressure sensor; 37 second opening and closing device; 100 air-conditioning apparatus; 101 air-conditioning apparatus; 200 outdoor unit; 201 compressor; 202 oil separator; 203 first flow switching device; 204 heat source side heat exchanger; 205 accumulator; 206 oil-return capillary; 207 first refrigerant pipe; 208 second refrigerant pipe; 209 third refrigerant pipe; 210 fifth refrigerant pipe; 211 sixth refrigerant pipe; 212 fourth refrigerant pipe; 300 (300*a*, 300*b*, 300*c*, 300*d*) indoor unit; 301 (301*a*, 301*b*, 301*c*, 301*d*) use side heat exchanger; 302 (302*a*, 302*b*, 302*c*, 302*d*) expansion device; 400 (400*a*, 400*b*) refrigerant pipe; A refrigerant circuit; B heat medium circuit.

The invention claimed is:

1. An air-conditioning apparatus comprising a compressor, a radiator, an expansion device, an evaporator, and an accumulator, which are connected by a refrigerant pipe to form a refrigeration cycle, wherein: a refrigerant that flows through the refrigeration cycle is a tetrafluoropropene-based refrigerant or a refrigerant mixture having tetrafluoropropene as a main component, the refrigerant pipe that connects from the accumulator to a suction side of the compressor and the refrigerant pipe that connects from the evaporator to the accumulator are configured by a plurality of pipes connected in parallel, respectively, and an inside diameter of each of the plurality of pipes connected in parallel is set in accordance with an output of the compressor.

2. The air-conditioning apparatus of claim 1, comprising:

a heat source side heat exchanger that is caused to function as the radiator or the evaporator; and a use side heat exchanger that is caused to function as the radiator or the evaporator, wherein in a case where the cooling operation and the heating operation can be switched by switching a flow of the refrigerant, in the heating operation, the use side heat exchanger is caused to function as the radiator, and the heat source side heat exchanger is caused to function as the evaporator, and in the cooling operation, the heat source side heat exchanger is caused to function as the radiator, and the use side heat exchanger is caused to function as the evaporator.

3. The air-conditioning apparatus of claim 1, comprising:

a heat source side heat exchanger that is caused to function as the radiator or the evaporator; and a plurality of heat exchangers related to heat medium that are each caused to function as the radiator or the evaporator, and are connected to a plurality of use side heat exchangers by a heat medium pipe, wherein in a case where a heating only operation, a cooling only operation, and a cooling and heating mixed operation can be performed by switching a flow of the refrigerant flowing into the plurality of heat exchangers related to heat medium, in the heating only operation, the heat source side heat exchanger is caused to function as the radiator, and the heat exchangers related to heat medium are each caused to function as the evaporator, in the cooling only operation, the heat source side heat exchanger is caused to function as the evaporator, and the heat exchangers related to heat medium are each caused to function as the radiator, and in the cooling and heating mixed operation, the heat source side heat exchanger is caused to function as the radiator or the evaporator, at least one of the heat exchangers related to heat medium is caused to function as the radiator, and a rest of the heat exchangers related to heat medium is caused to function as the evaporator.

4. The air-conditioning apparatus of claim 1, wherein:

the compressor and a heat source side heat exchanger are included in an outdoor unit; and the plurality of pipes connected in parallel are provided within the outdoor unit.

5. The air-conditioning apparatus of claim 1, wherein in a case where the compressor has an output of approximately 22 kW, the inside diameter of each of the plurality of pipes connected in parallel is set to be not more than 26.9 mm.

6. The air-conditioning apparatus of claim 1, wherein in a case where the compressor has an output of approximately 28 kW to 33 kW, the inside diameter of each of the plurality of pipes connected in parallel is set to be not more than 31.5 mm.

7. The air-conditioning apparatus of claim 1, wherein in a case where the compressor has an output of approximately 40 kW, the inside diameter of each of the plurality of pipes connected in parallel is set to be not more than 35.9mm.

8. The air-conditioning apparatus of claim 1, wherein the refrigerant that flows through the refrigeration cycle is HF01234yf.

9. The air-conditioning apparatus of claim 1, wherein the refrigerant that flows through the refrigeration cycle is HF01234ze.

10. The air-conditioning apparatus of claim 1, wherein the refrigerant that flows through the refrigeration cycle has HF01234yf as a main component.

11. The air-conditioning apparatus of claim 1, wherein the refrigerant that flows through the refrigeration cycle has HF01234ze as a main component.

12. The air-conditioning apparatus of claim 1, wherein the refrigerant that flows through the refrigeration cycle is a refrigerant such that the ratio of the weight of the refrigerant encapsulated in the refrigeration cycle to the weight of the tetrafluoropropene-based refrigerant is 75% or more.

* * * * *